US011660885B2

(12) United States Patent
Hayakawa et al.

(10) Patent No.: US 11,660,885 B2
(45) Date of Patent: May 30, 2023

(54) PRINTING APPARATUS

(71) Applicant: SEIKO EPSON CORPORATION, Tokyo (JP)

(72) Inventors: Naoto Hayakawa, Matsumoto (JP); Keisuke Yamaya, Shiojiri (JP); Keishi Sawada, Shiojiri (JP); Kenichi Tanioka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 53 days.

(21) Appl. No.: 17/160,033

(22) Filed: Jan. 27, 2021

(65) Prior Publication Data

US 2021/0237487 A1 Aug. 5, 2021

(51) Int. Cl.
*B41J 11/70* (2006.01)

(52) U.S. Cl.
CPC ..... *B41J 11/70* (2013.01)

(58) Field of Classification Search
CPC ..... B41J 11/663; B41J 11/70; B65H 5/00
See application file for complete search history.

(56) References Cited

U.S. PATENT DOCUMENTS

2012/0062927 A1* 3/2012 Tsuji ..... B41J 11/70 358/1.13
2014/0011654 A1* 1/2014 Maeda ..... B23Q 15/00 493/369
2018/0118499 A1* 5/2018 Fukushima ..... B65H 29/60
2019/0030924 A1 1/2019 Takahashi
2020/0317461 A1* 10/2020 Toyoizumi ..... B65H 35/008

FOREIGN PATENT DOCUMENTS

JP 2017-177582 10/2017

* cited by examiner

*Primary Examiner* — Scott A Richmond
(74) *Attorney, Agent, or Firm* — Workman Nydegger

(57) ABSTRACT

A printing apparatus includes a printing unit configured to print on a medium, a cutting unit configured to cut the medium, and an accommodating unit configured to accommodate cutting waste, in which the cutting unit is configured to cut the medium at a boundary between a downstream margin that is an area between a second end that is a downstream end of the medium and a print area, and the print area, and is configured to cut the medium at a boundary between an upstream margin that is an area between a first end that is an upstream end of the medium and the print area, and the print area, and gaps communicating with the accommodating unit are configured upstream and downstream of a position in which the medium is cut by the cutting unit in the transport path.

13 Claims, 17 Drawing Sheets

PRINTING APPARATUS

The present application is based on, and claims priority from JP Application Serial Number 2020-014622, filed Jan. 31, 2020, the disclosure of which is hereby incorporated by reference herein in its entirety.

BACKGROUND

1. Technical Field

The disclosure relates to a printing apparatus.

2. Related Art

For example, a printer, which is an example of a printing apparatus described in JP-A-2017-177582, includes a printing unit configured to print on a medium, and a cutting unit configured to cut the medium downstream of the printing unit in a transport path where the medium is transported. Then, the cutting waste generated when the medium is cut by the cutting unit is collected in a collection box arranged below the cutting unit.

In the typical printer described above, the cutting waste cut off from the medium by the cutting unit falls into the collection box below through a gap provided upstream of a cutting position in which the medium is cut by the cutting unit in the transport path. In this case, when an upstream margin on the upstream end side in the medium is cut off from the medium as the cutting waste, the cutting waste can be collected in the collection box below through the gap upstream of the cutting position. However, when a downstream margin on the downstream end side of the medium is cut off from the medium as the cutting waste, the cutting waste is generated downstream of the cutting position. Therefore, it is difficult to collect the cutting waste in the collection box below through the gap provided upstream of the cutting position.

SUMMARY

A printing apparatus for solving the above-described problem includes a printing unit configured to print on a medium, a cutting unit configured to cut the medium downstream of the printing unit in a transport path through which the medium is transported, and an accommodating unit disposed below the cutting unit and configured to accommodate cutting waste generated when the medium is cut by the cutting unit, in which the cutting unit is configured to cut the medium at a boundary between a downstream margin that is an area between a downstream end of the medium and a print area on which printing is performed by the printing unit and the print area, and is configured to cut the medium at a boundary between an upstream margin that is an area between an upstream end of the medium and the print area, and the print area, and gaps communicating with the accommodating unit are configured upstream and downstream of a position in which the medium is cut by the cutting unit in the transport path.

DESCRIPTION OF EXEMPLARY EMBODIMENTS

Figure 1:
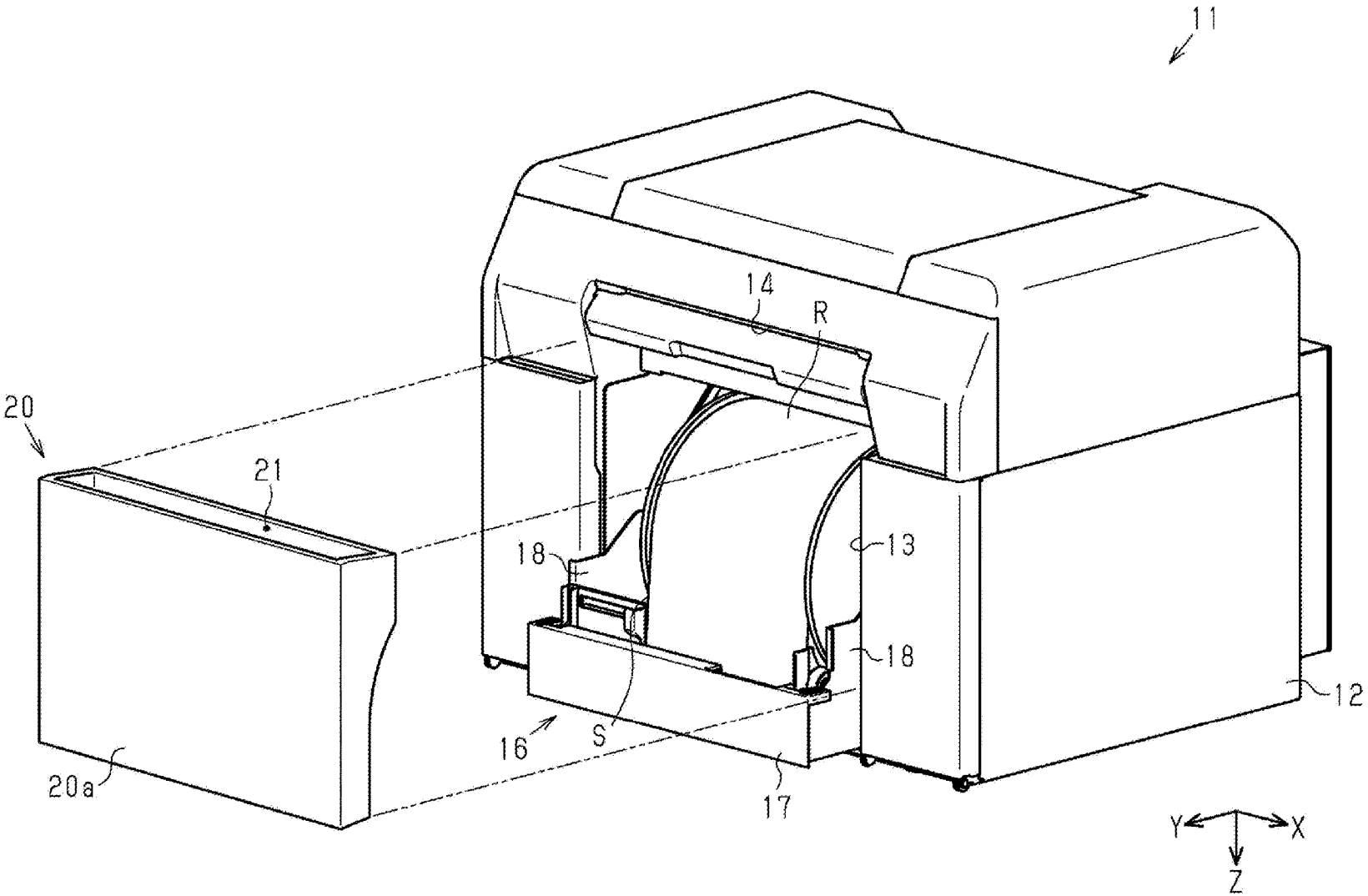
FIG. 1 is a perspective view of an embodiment of a printing apparatus.

Hereinafter, an embodiment of a printing apparatus will be described with reference to the drawings. The printing apparatus is, for example, an ink-jet printer that print by ejecting ink onto a medium such as paper.

In the drawings, the direction of gravity is indicated by a Z axis and directions along a plane intersecting the Z axis are indicated by an X axis and a Y axis, assuming that a printing apparatus 11 is placed at a horizontal plane. The X, Y, and Z axes are orthogonal to each other. In the following description, a direction parallel to the X axis is also referred to as a width direction X, a direction parallel to the Y axis is also referred to as a front-rear direction Y, which is also a depth direction of the printing apparatus 11, and a direction parallel to the Z axis is also referred to as a vertical direction Z.

As illustrated in FIG. 1, the printing apparatus 11 of the embodiment includes a housing 12. The housing 12 includes an opening portion 13 that opens to a front side in the front-rear direction Y, and a discharge port 14 through which a printed medium S is discharged. The discharge port 14 is formed at the front face of the housing 12 on the upper side of the opening portion 13.

The printing apparatus 11 includes a feeding portion 16 that feeds the medium S from a roll body R in which the long medium S is wound in a cylindrical shape. The feeding portion 16 is accommodated in the housing 12 in a state in which the medium S can be pulled out from the housing 12 through the opening portion 13. The feeding portion 16 includes a front plate portion 17 that constitutes a part of the exterior of the printing apparatus 11 when accommodated in the housing 12, and a pair of support walls 18 that rotatably support the roll body R.

Figure 2:
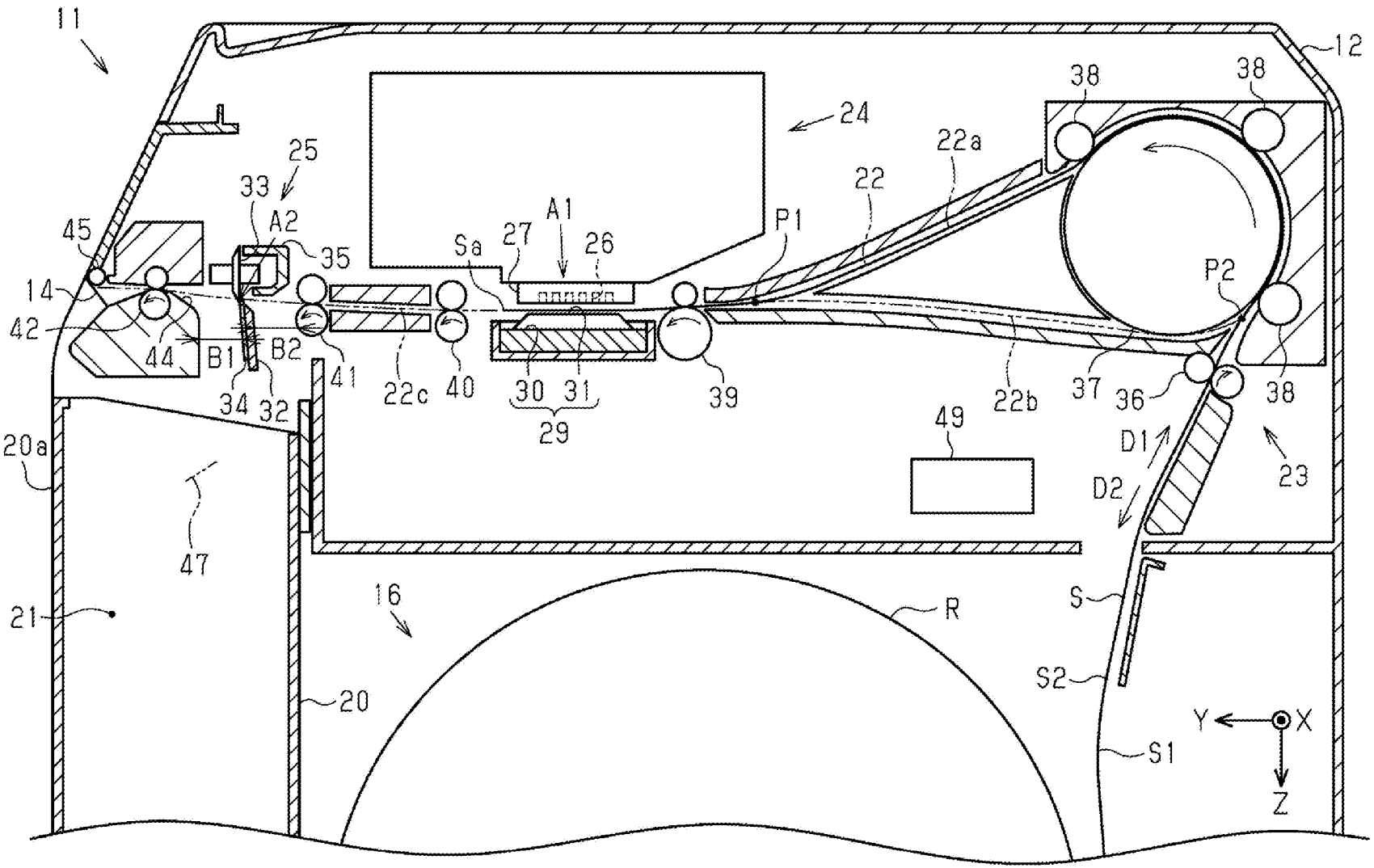
FIG. 2 is a cross-sectional view illustrating the printing apparatus performing a medium feeding step and a first printing step.

The printing apparatus 11 includes an accommodating unit 20 capable of accommodating a cut-off portion as cutting waste 47 as illustrated by a two-dot chain line in FIG. 2, from the long medium S. The accommodating unit 20 is a bottomed box with an opening on the upper side in the vertical direction Z, and an internal space thereof constitutes an accommodating chamber 21 capable of accommodating the cutting waste 47. The accommodating unit 20 of the embodiment is detachably attached to the housing 12, and when the accommodating unit 20 is attached to the housing 12 to close the opening portion 13, a front face 20*a* thereof is flush with the front plate portion 17 of the feeding portion 16 to constitute a part of the exterior of the printing apparatus 11. When the accommodating unit 20 is removed from the housing 12, the feeding portion 16 can be pulled out from the housing 12.

As illustrated in FIG. 2, the printing apparatus 11 includes a transport path 22 indicated by a two-dot chain line for transporting the medium S. The printing apparatus 11 includes a transport unit 23 that transports the medium S along the transport path 22, a printing unit 24 that prints on the medium S, and a cutting unit 25 that cuts the medium S.

The printing unit 24 includes an ejection head 27 including a nozzle 26 capable of ejecting ink. The ejection head 27 may be a line head capable of simultaneously ejecting ink in the width direction X over substantially the entire area of the medium S, or a serial head capable of ejecting ink while reciprocating in a direction parallel to the width direction X.

The printing apparatus 11 includes a support portion 29 that support a portion of the long medium S upward in the vertical direction Z. This portion is printed by the printing unit 24. The support portion 29 of the embodiment includes an ink receiver 30 that receives ink ejected from the printing unit 24, and a support face 31 that supports the medium S. The ink receiver 30 may be constituted by an absorber that absorbs ink. The ink receiver 30 receives ink ejected to the outside of the medium S, for example, when the printing unit 24 performs borderless printing. The support face 31 is located above the ink receiver 30 in the vertical direction Z. In other words, the support face 31 is located between the ejection head 27 and the ink receiver 30. In the embodiment, a position between the support face 31 and the ejection head 27 in the transport path 22 is referred to as a printing position A1. The printing unit 24 prints on a portion, which is located at the printing position A1, of the medium S that is transported in the transport path 22.

The transport path 22 is a space in which the medium S is movable, and is constituted by a plurality of members. The transport path 22 continues from the feeding portion 16 located at the uppermost stream to the discharge port 14 located most downstream. The printing unit 24, the support portion 29, and the cutting unit 25 constitute a part of the transport path 22.

As illustrated in FIG. 2, the cutting unit 25 is located in the transport path 22 downstream of the printing unit 24 and upstream of the discharge port 14, and cuts the medium S at a cutting position A2. That is, the cutting position A2 is located in the transport path 22 downstream of the printing unit 24 and upstream of the discharge port 14. The cutting position A2 is a position above the accommodating chamber 21 when viewed from the accommodating unit 20 attached to the housing 12. Below the cutting unit 25 where the cutting edge is located at the cutting position A2, the accommodating unit 20 that accommodates the cutting waste 47 generated by cutting the medium S by the cutting unit 25 is disposed.

The cutting unit 25 of the embodiment includes a fixed blade 34 having a blade line extending in the width direction X intersecting the transport path 22, a guide member 35 provided so as to extend along the blade line of the fixed blade 34, and a moving blade 33 mounted to the guide member 35 so as to be movable along the blade line of the fixed blade 34. The fixed blade 34 is fixed to a main body frame 32 located below the transport path 22, and the guide member 35 is fixed to a main body frame (not illustrated) located above the transport path 22. At the cutting position A2 which is the position of the cutting edge of the fixed blade 34 in the transport path 22, the cutting unit 25 reciprocates the moving blade 33 in a first direction along the blade line of the fixed blade 34 and in a second direction opposite to the first direction, thereby cutting the medium S across the width direction X.

Figure 3:
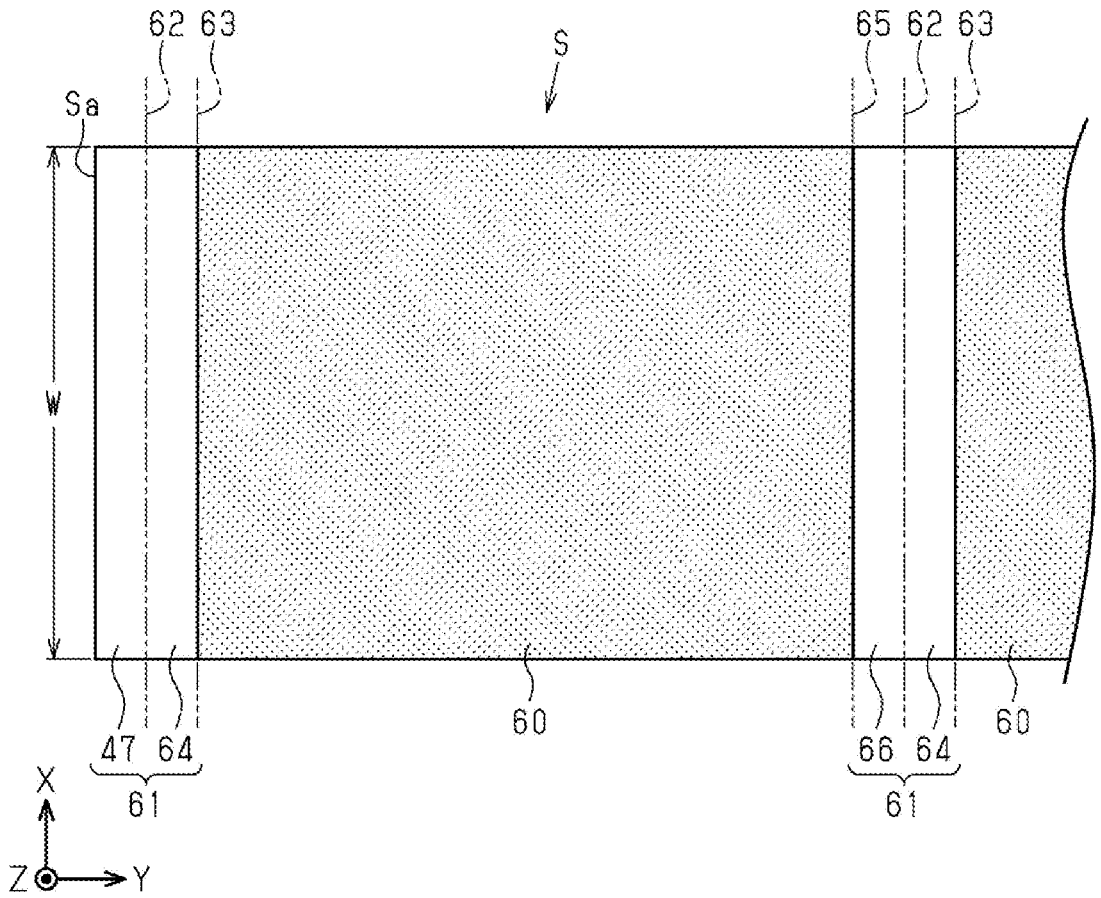
FIG. 3 is a plan view of the medium after the first printing step.
Figure 4:
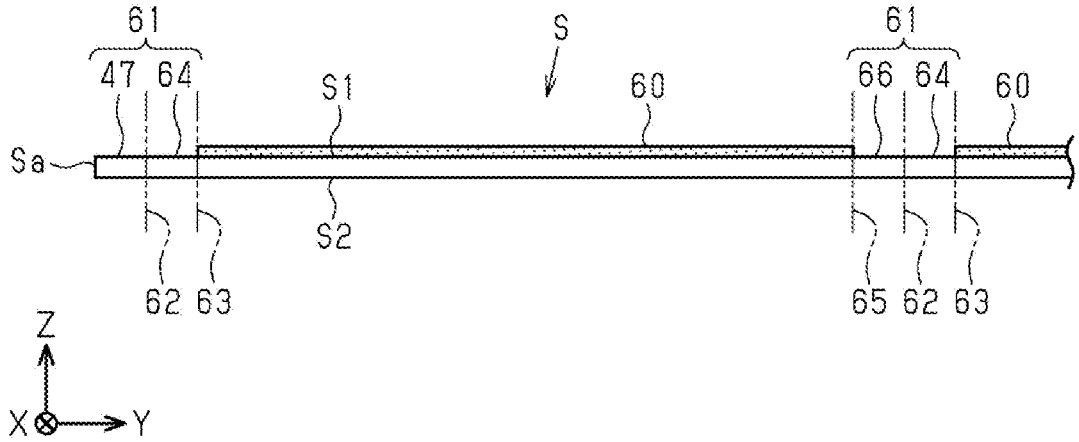
FIG. 4 is a cross-sectional view of the medium after the first printing step.

As illustrated in FIGS. 3 and 4, the long medium S before being cut by the cutting unit 25 is a strip-shaped sheet having a dimension W in the width direction X shorter than the length of the fixed blade 34 along the width direction X, and has a first surface S1 and a second surface S2 that is different from the first surface S1. Printing can be performed by the printing unit 24 at both the first surface S1 and the second surface S2. The first surface S1 is an outer surface when the medium S is in a state of the roll body R, and the second surface S2 is a surface opposite to the first surface S1. The medium S illustrated in FIGS. 3 and 4 has a print area 60 in which images such as characters and figures have already been printed on the first surface S1 of the medium S by the printing unit 24.

In this case, when the medium S is unwound from the roll body R and transported downstream in the transport path 22, the area between a downstream end Sa and the print area 60 printed by the printing unit 24 is a margin portion 61 at which no image is printed. On the first surface S1 of the long medium S, a plurality of margin portions 61 and a plurality of print areas 60 are formed so as to be alternately located from the downstream end Sa toward the upstream side. Then, the long medium S in which the plurality of print areas 60 are alternately formed with the plurality of margin portions 61 on the first surface S1 is cut along the cutting line 62 extending in the width direction X at a position intermediate between two print areas 60 adjacent to the margin portion 61 in the front-rear direction Y.

By cutting along the cutting line 62, on the downstream side of the print area 60 in the medium S, a margin 64 adjacent to the print area 60 with a boundary 63 along the width direction X interposed therebetween is left as a downstream margin. On the other hand, on the upstream side of the print area 60 in the medium S, a margin 66 adjacent to the print area 60 with a boundary 65 along the width direction X interposed therebetween is left as an upstream margin. Then, by cutting at these two cutting lines 62, from the long medium S, a sheet-like cut piece in which the margin 64 on the downstream end side, the print area 60, and the margin 66 on the upstream end side are disposed on the first surface S1 in the front-rear direction Y is separated.

Note that, of the margin portion 61 adjacent to the downstream end Sa in the long medium S, the margin 64 that becomes the downstream margin when cutting at the cutting line 62 becomes the cutting waste 47 that falls toward the accommodating unit 20. In addition, unlike so-called double-sided printing in which the medium S is inverted after printing on the first surface S1 and also printing on the second surface S2, in a case of so-called single-sided printing in which printing is performed only on the first side S1, the medium S may be cut at the boundary 63 between the margin portion 61 on the downstream end side and the print area 60 and the boundary 65 between the margin portion 61 on the upstream end side and the print area 60, instead of the portions of the cutting lines 62. In this case, one sheet-like cut piece having no margin on the downstream end side and the upstream end side on the first surface S1, and having only the print area 60 is separated from the long medium S.

As illustrated in FIG. 2, the transport path 22 has a supply path 22*a* and an inversion path 22*b* upstream of the printing position A1, and a discharge path 22*c* downstream of the printing position A1. The supply path 22*a* is a passage connecting the feeding portion 16 located at the uppermost stream in the transport path 22 and the printing position A1 in which the printing unit 24 is located. The inversion path 22*b* is a passage connecting a branch point P1 branching from the supply path 22*a* upstream of the printing position A1 in the transport path 22, and a junction P2 joining the supply path 22*a* upstream of the branch point P1. The discharge path 22*c* is a passage connecting the printing position A1 and the discharge port 14 located most downstream in the transport path 22.

The transport unit 23 unwinds the medium S from the roll body R on which the medium S is wound and transports the medium S. The transport unit 23 includes a supply roller pair 36, an inverting roller 37, a driven roller 38, and an upstream transport roller pair 39, which are sequentially provided in the supply path 22*a* from the upstream side. The transport unit 23 may include a plurality of driven rollers 38. The driven roller 38 is rotatably provided and driven to rotate with the medium S pinched between the driven roller 38 and the inverting roller 37. The transport unit 23 includes a downstream transport roller pair 40, a first roller pair 41, and a second roller pair 42, which are sequentially provided in the discharge path 22*c* from the upstream side. The first roller pair 41 is located upstream of the cutting unit 25 in the transport path 22. The second roller pair 42 is located downstream of the cutting unit 25 in the transport path 22.

The supply roller pair 36, the inverting roller 37, the driven roller 38, the upstream transport roller pair 39, the downstream transport roller pair 40, the first roller pair 41, and the second roller pair 42 transport the medium S by rotating with the medium S pinched therebetween. The transport unit 23 transports the medium S from the upstream side to the downstream side by being driven in forward rotation, and transports the medium S from the downstream side to the upstream side by being driven in reverse rotation. In the embodiment, the direction toward the downstream side along the transport path 22 is referred to as the forward feeding direction D1, and the direction toward the upstream side is referred to as the reverse feeding direction D2.

The printing apparatus 11 may include a contact portion 44 provided upstream of the second roller pair 42, and a guide portion 45 provided downstream of the second roller pair 42. The guide portion 45 of the embodiment is constituted by a rotatable roller and is provided at the ceiling of the transport path 22. The ceiling of the transport path 22 is one of those that define a space through which the medium S can pass, and is located above the medium S in the vertical direction Z.

The contact portion 44 is located between the cutting unit 25 and the second roller pair 42, and is provided apart from the cutting unit 25 in the forward feeding direction D1. That is, between the fixed blade 34 of the cutting unit 25 and a member having the contact portion 44, a gap B1 is formed through which the cutting waste 47 cut off from the medium S can pass below the vertical direction Z on the downstream side of the cutting position A2. The gap B1 is located above the accommodating chamber 21 of the accommodating unit 20 attached to the housing 12. In other words, downstream of the cutting position A2 where the medium S is cut by the cutting unit 25 in the transport path 22, the gap B1 communicating with the accommodating chamber 21 of the accommodating unit 20 is configured. Thus, the paper-piece shaped cutting waste 47 cut off from the long medium S on the downstream side of the cutting position A2 falls through the gap B1 and is accommodated in the accommodating chamber 21 of the accommodating unit 20.

On the other hand, also between the first roller pair 41 located away from the cutting unit 25 in the reverse feeding direction D2 and the fixed blade 34 of the cutting unit 25, that is, upstream of the cutting position A2, a gap B2 is formed through which the paper-piece shaped cutting waste 47 can pass below the vertical direction Z in the transport path 22, similar to the gap B1 downstream of the cutting position A2. Similar to the gap B1, the gap B2 is also located above the accommodating chamber 21 of the accommodating unit 20 attached to the housing 12. In other words, also upstream of the cutting position A2 where the medium S is cut by the cutting unit 25 in the transport path 22, the gap B2 communicating with the accommodating chamber 21 of the accommodating unit 20 is configured. Thus, the paper-piece shaped cutting waste 47 generated by cutting by the cutting unit 25 on the upstream side of the cutting position A2 falls through the gap B2 and is accommodated in the accommodating chamber 21 of the accommodating unit 20. As described above, the accommodating chamber 21 of the accommodating unit 20 communicates with both the gap B1 downstream and the gap B2 upstream of the cutting position A2.

In the transport path 22 of the embodiment, the height in the vertical direction Z is not constant from the upstream side to the downstream side, and is partially different. For example, in the transport path 22, the height upstream of the cutting unit 25 is set to be lower than the height downstream of the cutting unit 25. The height downstream of the cutting unit 25 is the height of the transport path 22 at the upstream end of the contact portion 44, and is lower than the height of the transport path 22 at the downstream end of the contact portion 44. The contact portion 44 of the embodiment is an ascending slope in which the downstream end is located above the upstream end and goes up in the forward feeding direction D1.

The printing apparatus 11 includes a control unit 49 that controls various operations to be executed by the printing apparatus 11. The control unit 49 is constituted, for example, by a computer and a processing circuit including a memory, and controls the printing unit 24, the cutting unit 25, the transport unit 23, and the like in accordance with a program stored in the memory.

Next, the effects of the embodiment will be described.

The printing apparatus 11 transports the medium S based on a method of the transport control including a forward feeding step, a cutting step, an overlapping step, and a reverse feeding step. Based on the transport control method, a feeding step of feeding the medium S, a first printing step and a second printing step of printing at the medium S, a cutting-off step of cutting off the end of the medium S as the cutting waste 47, and inverting step of inverting the medium S are executed. When printing without borders on both sides of the medium S, the printing apparatus 11 of the embodiment executes the feeding step, the first printing step, the cutting-off step, the forward feeding step, the cutting step, the overlapping step, the reverse feeding step, the inverting step, the second printing step, and the cutting-off step in this order.

The control unit 49 controls the drive of each mechanism based on the drive time of the upstream transport roller pair 39, the inverting roller 37, and the like. The printing apparatus 11 includes sensors that detect the amount of rotation of the upstream transport roller pair 39, the inverting roller 37, and the like. The printing apparatus 11 includes a sensor that detects the medium S. Then, the control unit 49 controls the drive of each mechanism based on the detection results of the sensors.

As illustrated in FIG. 2, the control unit 49 drives the transport unit 23, thereby executing the feeding step of transporting the medium S unwound from the roll body R to the printing position A1 along the supply path 22*a*. Specifically, the control unit 49 drives the transport unit 23 in forward rotation to transport the medium S in the forward feeding direction D1, and transports the medium S fed from the feeding portion 16 to the printing position A1.

When the portion of the medium S that becomes the print area 60 reaches the printing position A1, the control unit 49 executes the first printing step of printing on the first surface S1 of the medium S by ejecting ink from the printing unit 24. In the first printing step, while the transport unit 23 transports the medium S in the forward feeding direction D1, the printing unit 24 prints by ejecting ink toward the portion located at the printing position A1 of the first surface S1 of the medium S. At this time, the printing unit 24 treats an elongated portion in the width direction X, which is a portion extending upstream from the downstream end Sa on the first surface S1 of the medium S, as a non-printable margin portion 61, and prints an image in the print area 60 adjacent to the upstream side of the margin portion 61.

Figure 5:
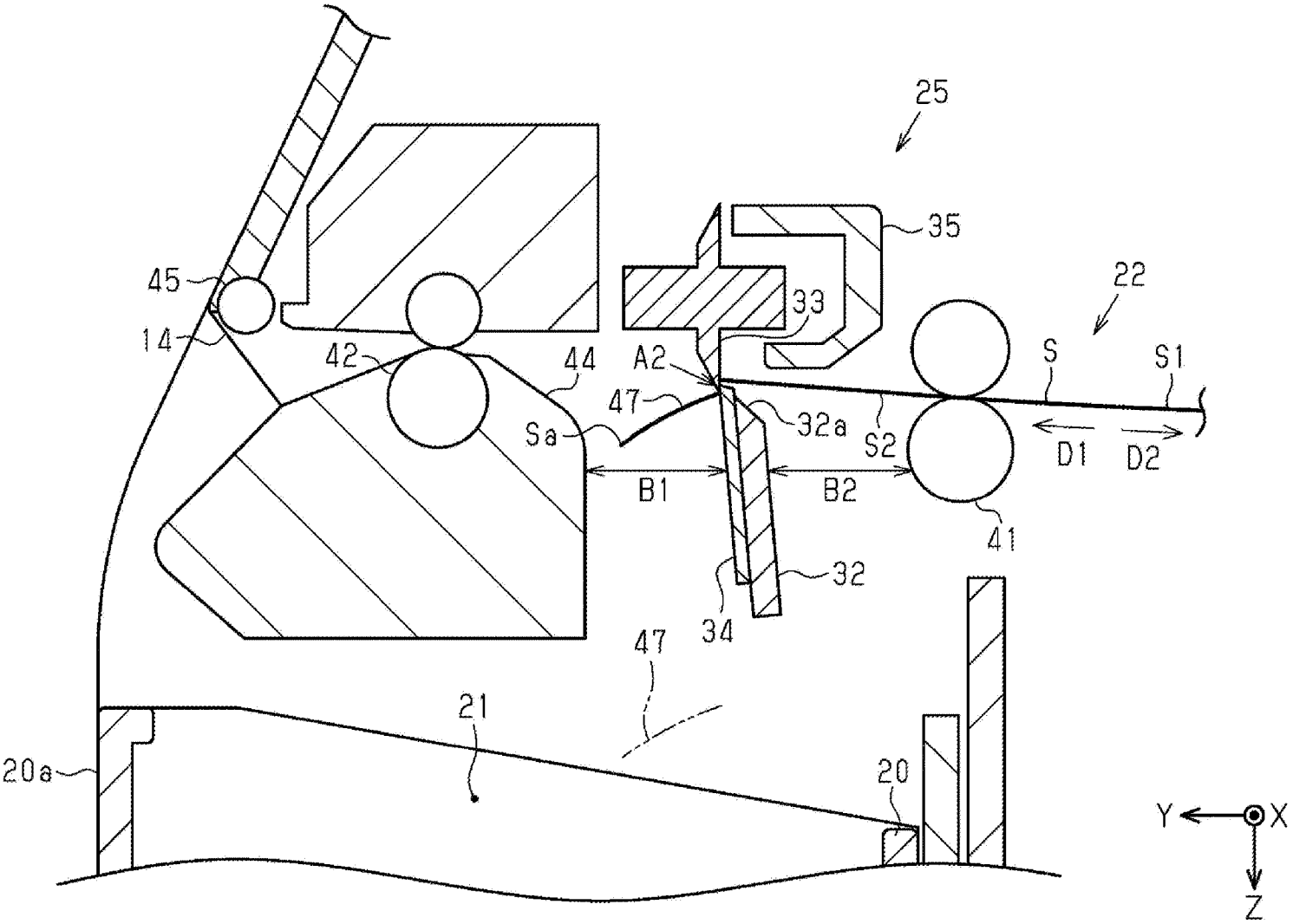
FIG. 5 is a cross-sectional view illustrating the printing apparatus performing a step of cutting-off cutting waste.

Next, as illustrated in FIG. 5, when the downstream end Sa of the medium S being transported in the forward feeding direction D1 passes through the cutting position A2 and the intermediate position of the margin portion 61 in the front-rear direction Y reaches the cutting position A2, the control unit 49 executes the cutting-off step in which the cutting unit 25 cuts the medium S along the cutting line 62 illustrated in FIGS. 3 and 4 and cuts off the cutting waste 47 from the medium S. The cutting-off step is performed with the transportation of the medium S stopped. In the cutting-off step, the cutting waste 47 cut off from the medium S on the downstream side of the cutting position A2 falls through the gap B1 below and is collected in the accommodating unit 20.

Note that, when a length in the apparatus from the position of the nozzle 26 located at the uppermost stream in the ejection head 27 of the printing unit 24 to the cutting position A2 of the cutting unit 25 is shorter than a length of the medium to the upstream end of one print area 60 to be printed on the upstream side of the margin portion 61 adjacent to the downstream end Sa of the long medium S, the control unit 49 executes the cutting-off step in the middle of the first printing step. On the other hand, when the length in the apparatus is longer than the length of the medium, the control unit 49 executes the cutting-off step after the first printing step is completed.

When the cutting-off step is completed, the control unit 49 executes the forward feeding step of transporting the medium S from which the cutting waste 47, which is a portion including the downstream end Sa, have been cut off downstream. In the forward feeding step, the control unit 49 drives the transport unit 23 in forward rotation and transports the medium S in the forward feeding direction D1. When the print area 60 printed in the first printing step passes through the cutting position A2, the control unit 49 stops the transportation of the medium S. Specifically, the control unit 49 stops the transportation when the upstream end of the margin 66 as the upstream margin adjacent to the print area 60 with the boundary 65 interposed therebetween reaches the cutting position A2.

Figure 6:
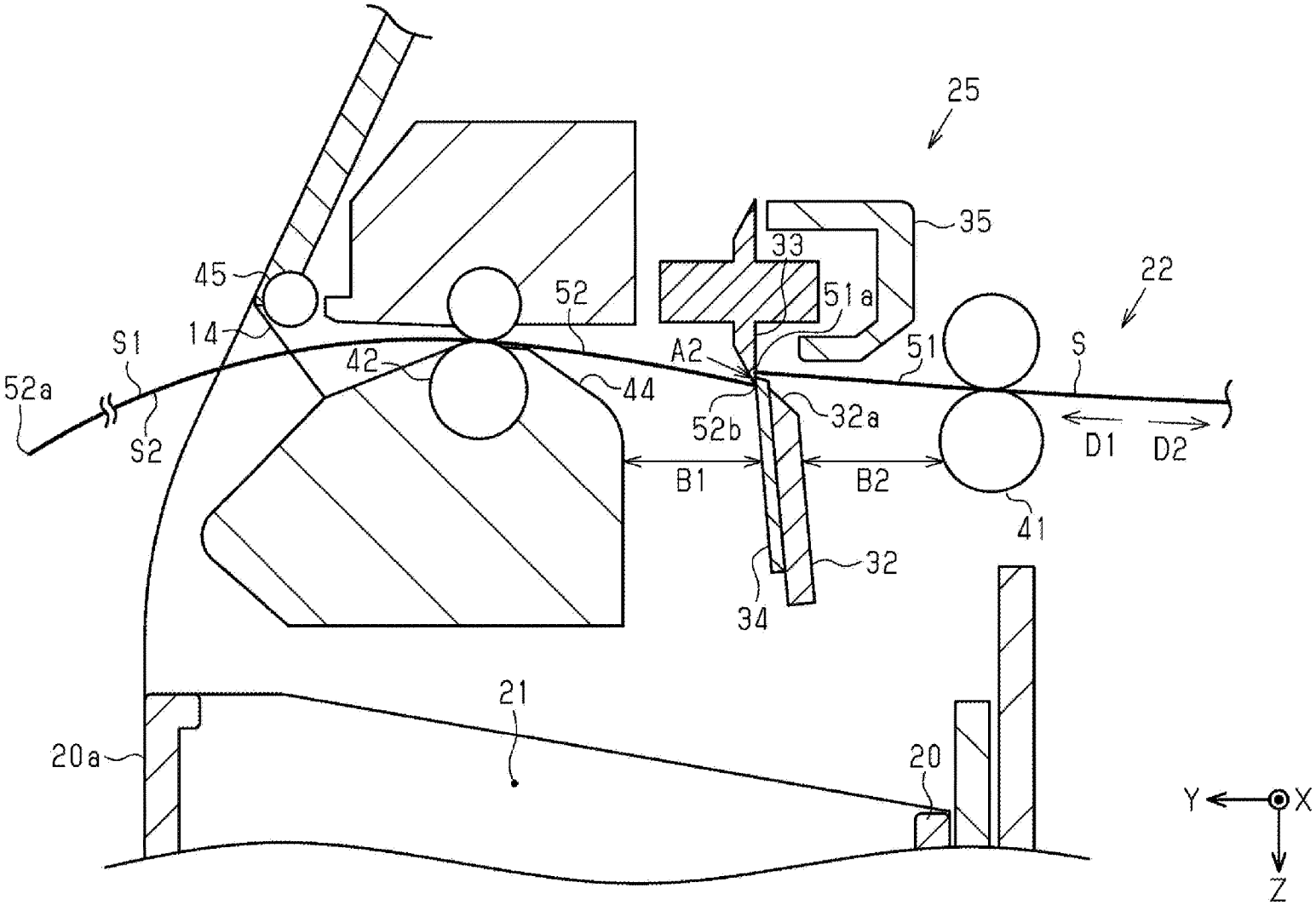
FIG. 6 is a cross-sectional view illustrating the printing apparatus performing a step of cutting the medium.

Next, as illustrated in FIG. 6, the control unit 49 executes the cutting step in which the cutting unit 25 cuts the medium S having the printed first surface S1 at the cutting position A2. The cutting unit 25 cuts the medium S in a state in which the transportation is stopped, and divides the medium S into a source portion 51 upstream of the cutting position A2 in the cutting unit 25 and a sheet-like cut piece 52 downstream of the cutting position A2. That is, the cutting unit 25 cuts the medium S along the cutting line 62 that separates the margin 66 and the margin 64, as illustrated in FIGS. 3 and 4. At this time, the first roller pair 41 holds the source portion 51 upstream of the cutting position A2 and the second roller pair 42 holds the cut piece 52 downstream of the cutting unit 25.

Downstream of the second roller pair 42 is provided the guide portion 45 that can guide the cut piece 52 by contacting the upper surface of the cut piece 52. Thus, in the medium S before cutting and the cut piece 52 after cutting, the printed surface is guided by the guide portion 45.

Figure 7:
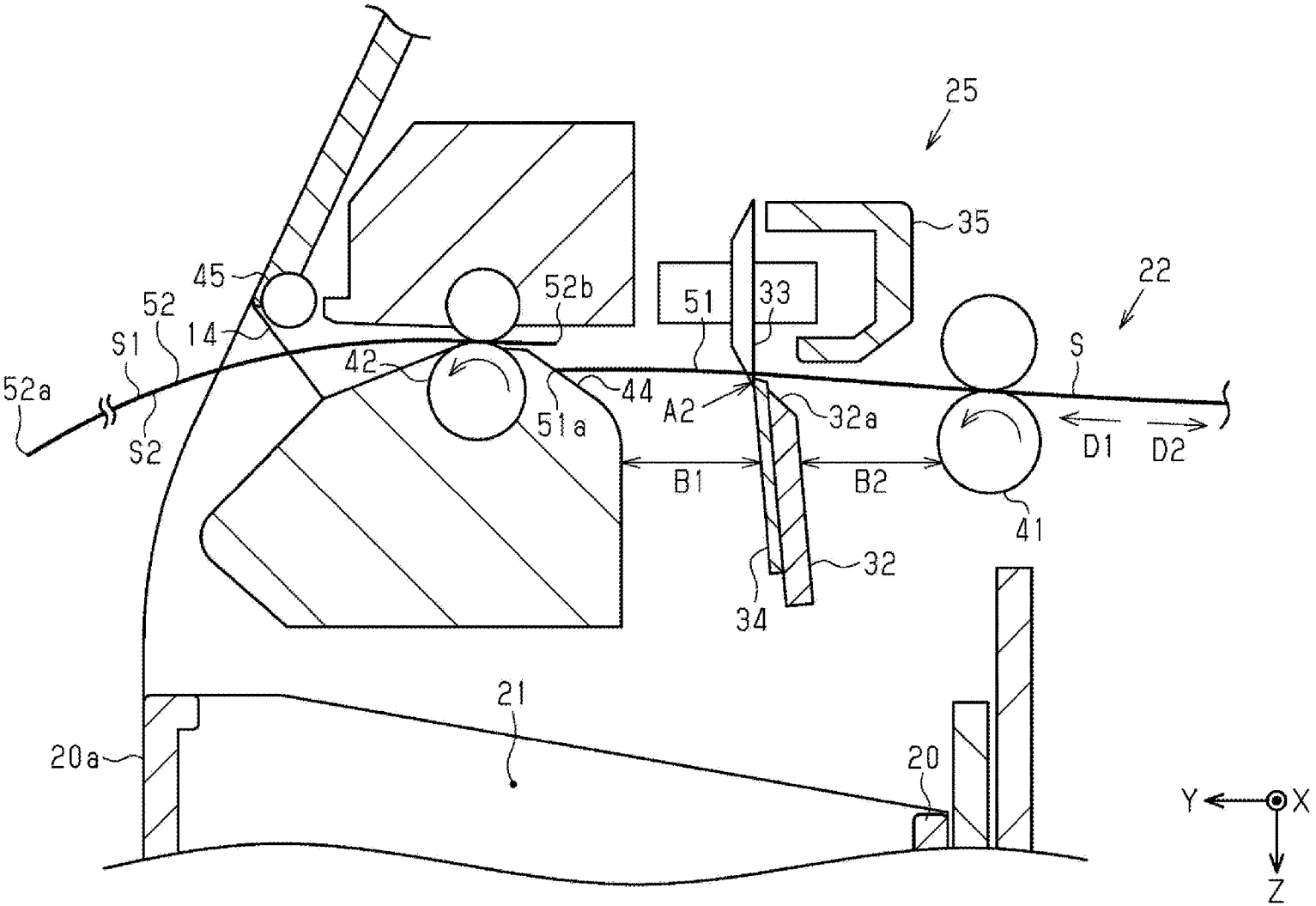
FIG. 7 is a cross-sectional view illustrating the printing apparatus performing a first half step of overlapping the medium.
Figure 8:
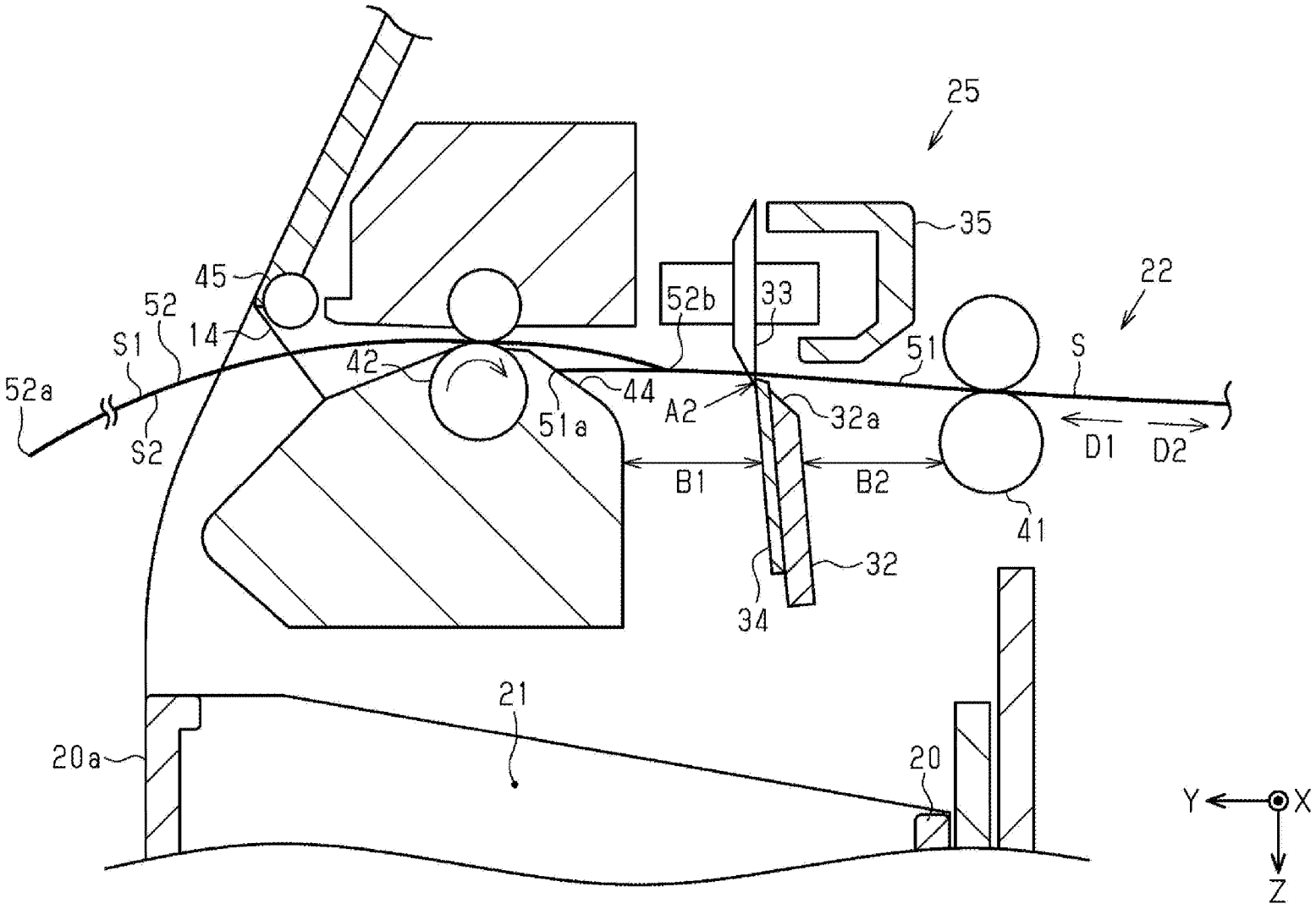
FIG. 8 is a cross-sectional view illustrating the printing apparatus performing a latter half step of overlapping the medium.

Next, as illustrated in FIGS. 7 and 8, the control unit 49 executes the overlapping step of overlapping a second end 52*b* and the source portion 51. The second end 52*b* is the upstream end when the sheet-like cut piece 52 having the printed first surface S1 is transported in the forward feeding direction D1. In the overlapping step, first, the control unit 49 drives the transport unit 23 in forward rotation to transport the source portion 51 and the cut piece 52 in the forward feeding direction D1 as illustrated in FIG. 7. Subsequently, as illustrated in FIG. 8, the control unit 49 drives the second roller pair 42 in reverse rotation while the drive of the first roller pair 41 is stopped.

As illustrated in FIG. 7, the gap B1 for dropping the cutting waste 47 is provided between the cutting position A2 where the medium S is cut by the cutting unit 25 and the contact portion 44. Thus, the source portion 51 of the medium S that has passed through the cutting position A2 moves downward so as to hang down due to the winding habit of being wound in the cylindrical shape and its own weight, and a downstream end 51*a* of the source portion 51 contacts the contact portion 44. When the downstream end 51*a* of the source portion 51 contacts the contact portion 44, the control unit 49 stops transportation of the source portion 51 and the cut piece 52 by stopping the drive of the transport unit 23.

The height of the cutting position A2 where the cutting unit 25 cuts the medium S and the contact portion 44 are located below a holding position where the second roller pair 42 pinches and holds the cut piece 52. The distance from the cutting position A2 to the contact portion 44 is longer than the distance from the holding position to the contact portion 44. Thus, when the downstream end 51*a* of the source portion 51 contacts the contact portion 44, the second end 52*b*, which is the upstream end of the cut piece 52 at that time, is located above the contact portion 44. In other words, the contact portion 44 is able to contact the downstream end 51*a* of the source portion 51 below the second end 52*b*, which is the upstream end of the cut piece 52 held by the second roller pair 42, in the vertical direction Z.

As illustrated in FIG. 8, when the second roller pair 42 is driven in reverse rotation while the drive of the first roller pair 41 is stopped, the second end 52*b* of the cut piece 52 overlaps the source portion 51. The overlapping at this time refers to a state in which the second end 52*b* of the cut piece 52 is located upstream of the downstream end 51*a* of the source portion 51, and is not limited to the state in which the cut piece 52 and the source portion 51 are in contact with each other, but also includes a state in which the cut piece 52 and the source portion 51 are separated from each other. The second end 52*b* of the cut piece 52 is located above the source portion 51 in a state of overlapping the source portion 51. In the cut piece 52 and the source portion 51, when the amount of overlap with each other is smaller than the respective lengths of the margin 66 of the cut piece 52 and the margin 64 of the source portion 51 in the front-rear direction Y, the margin can be cut off as the cutting waste 47 even when the overlapped portion is rubbed and scratched, for example.

Figure 9:
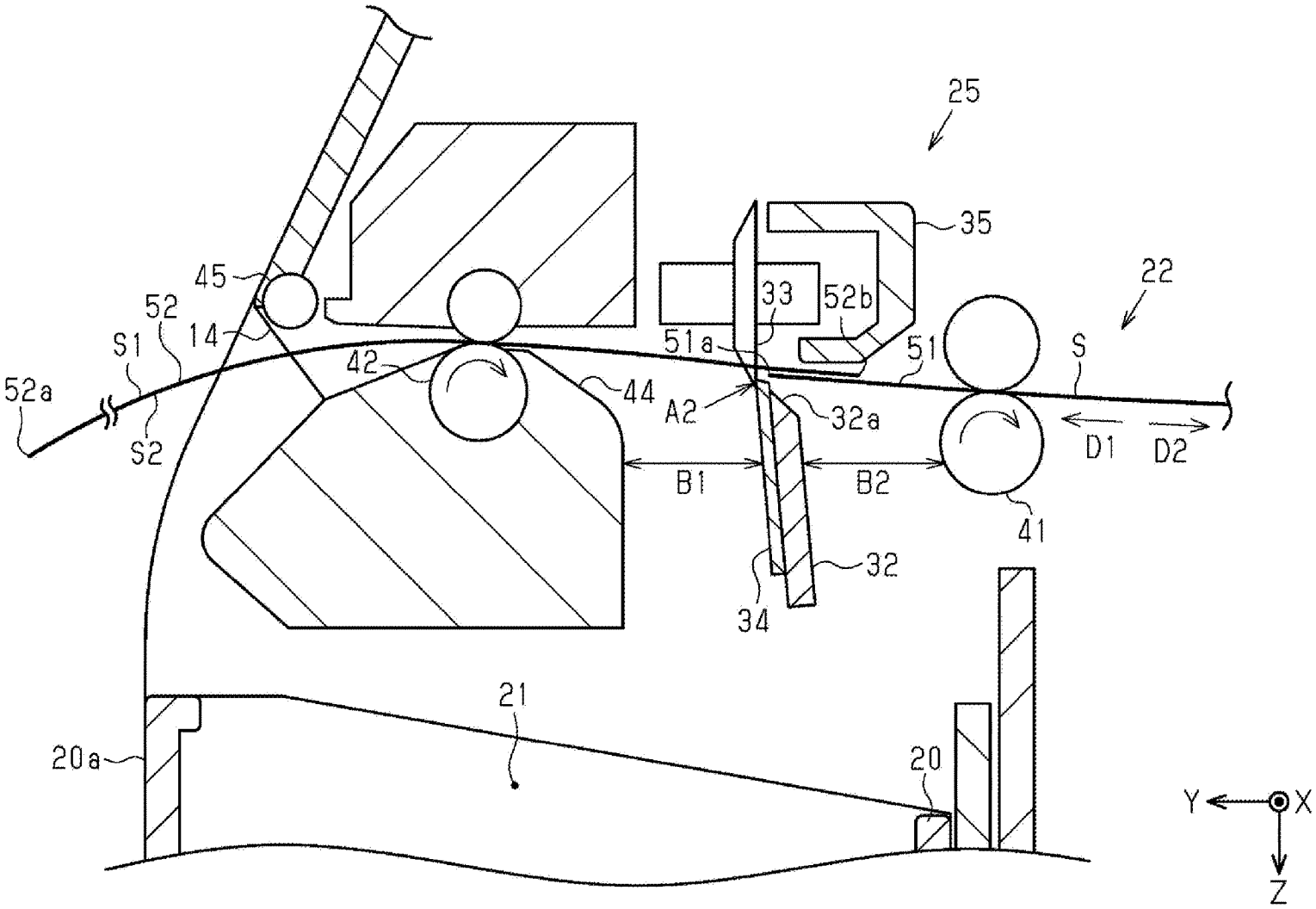
FIG. 9 is a cross-sectional view illustrating the printing apparatus immediately after starting a step of reverse feeding the medium.

Next, as illustrated in FIG. 9, the control unit 49 executes the reverse feeding step of transporting the cut piece 52 from the downstream side to the upstream side so that the second end 52*b* of the cut piece 52 passes through the cutting unit 25 in the state of overlapping the source portion 51. In the reverse feeding step, the transport unit 23 transports the cut piece 52 from the downstream side of the cutting unit 25 to the upstream side of the cutting unit 25, with the first surface S1 which is the outer surface of the roll body R as the upper surface of the cut piece 52.

The control unit 49 executes the reverse feeding step by driving the first roller pair 41 in reverse rotation in a state in which the second roller pair 42 is driven in the reverse rotation in the overlapping step. That is, the control unit 49 drives the transport unit 23 so that the first roller pair 41 starts rotating later than the second roller pair 42 in the overlapping step and the reverse feeding step. For example, the control unit 49 may individually control the drive of a motor that rotates the first roller pair 41 and a motor that rotates the second roller pair 42. The transport unit 23 may switch the power transmission by, for example, a clutch so that the first roller pair 41 and the second roller pair 42 start rotating with a time lag.

Figure 10:
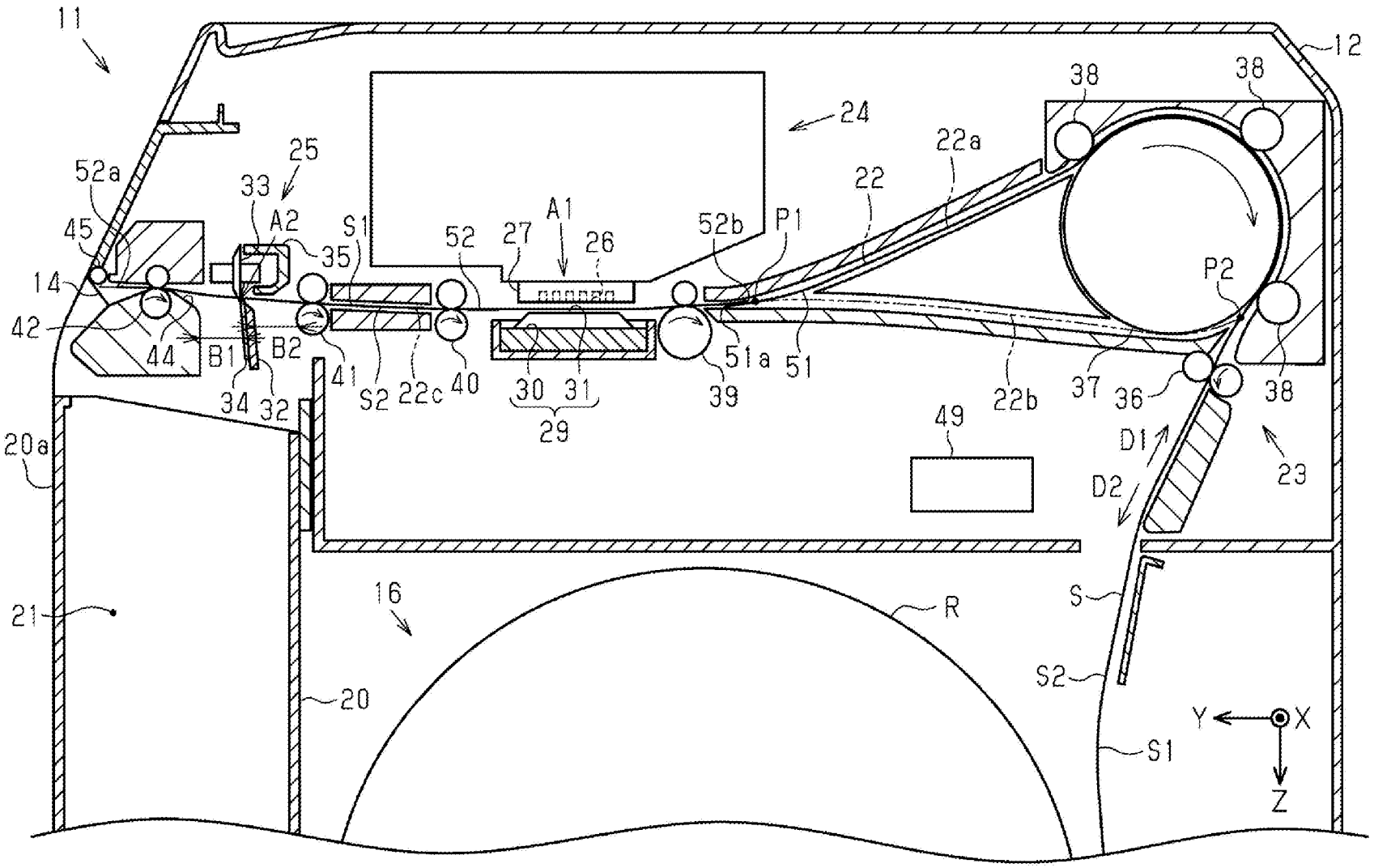
FIG. 10 is a cross-sectional view illustrating the printing apparatus performing the step of reverse feeding the medium.

Next, as illustrated in FIG. 10, the control unit 49, together with the first roller pair 41, drives the downstream transport roller pair 40, the upstream transport roller pair 39, the inverting roller 37, and the supply roller pair 36 in reverse rotation. The transport unit 23 transports the cut piece 52 and the source portion 51 from the downstream side to the upstream side so that the cut piece 52 and the source portion 51 passes through the cutting unit 25, the first roller pair 41, the downstream transport roller pair 40, the support portion 29, and the upstream transport roller pair 39 in this order in the state in which the second end 52*b* of the cut piece 52 overlaps the source portion 51. In other words, the transport unit 23 transports the second end 52*b* of the cut piece 52 to the upstream side of the first roller pair 41 in the state in which the second end 52*b* of the cut piece 52 overlaps the source portion 51. The transport unit 23 transports the second end 52*b* of the cut piece 52 to the upstream side of the ink receiver 30 in the state in which the second end 52*b* of the cut piece 52 overlaps the source portion 51.

When the second end 52*b* of the cut piece 52 and the downstream end 51*a* of the source portion 51, which are transported from the downstream side to the upstream side, pass through the upstream transport roller pair 39, the control unit 49 stops the drive of the upstream transport roller pair 39, the downstream transport roller pair 40, the first roller pair 41, and the second roller pair 42. Specifically, the control unit 49 stops the transportation of the cut piece 52 so that the overlapping portion of the cut piece 52 and the source portion 51 is located upstream of the upstream transport roller pair 39, and the second end 52*b* of the cut piece 52 is located between the branch point P1 at which the inversion path 22*b* branches from the supply path 22*a* and the upstream transport roller pair 39.

Figure 11:
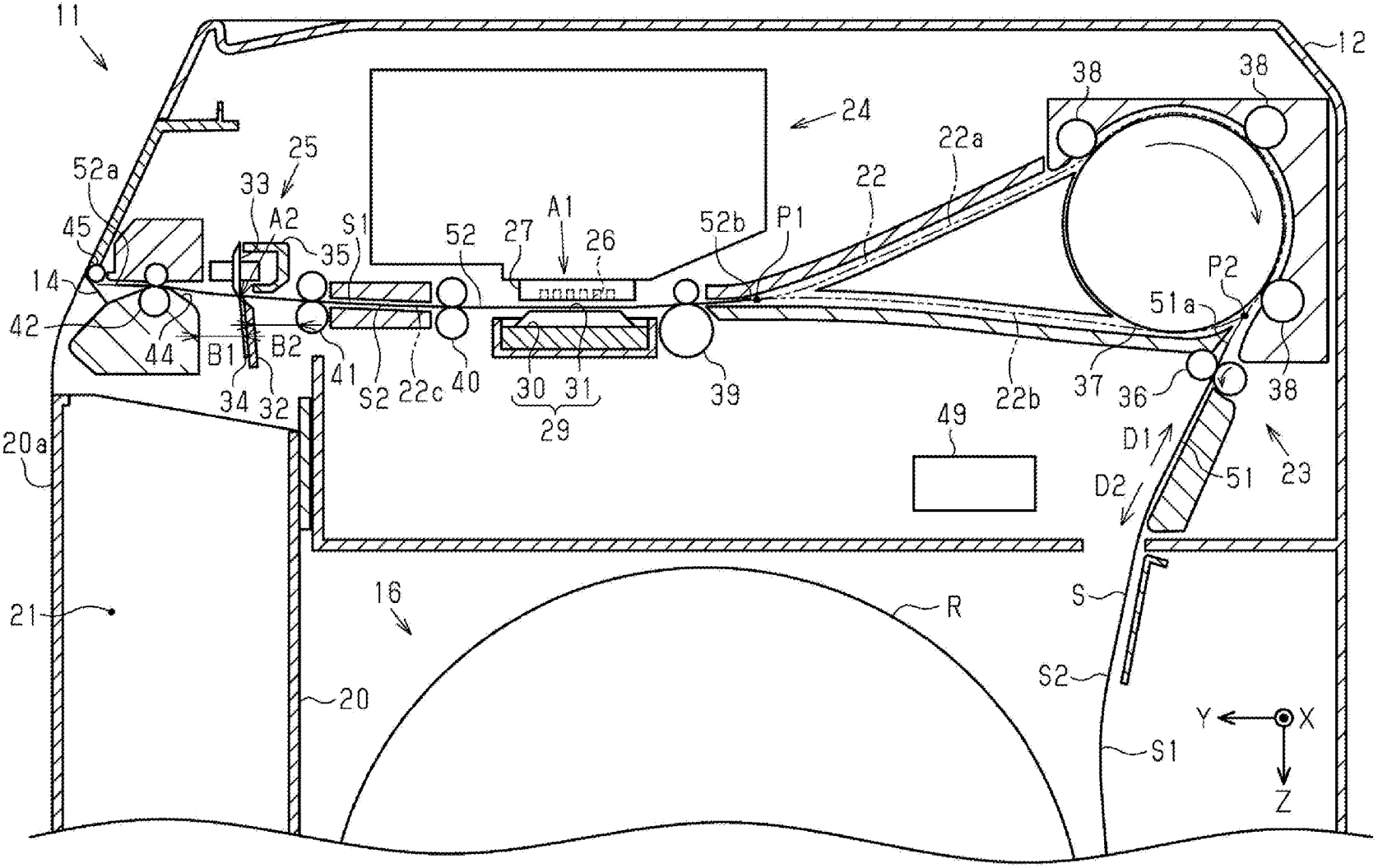
FIG. 11 is a cross-sectional view illustrating the printing apparatus immediately before an end of the step of reverse feeding the medium.

Next, as illustrated in FIG. 11, the control unit 49 stops the drive of the upstream transport roller pair 39, the downstream transport roller pair 40, the first roller pair 41, and the second roller pair 42, but continues the reverse rotation drive of the inverting roller 37 and supply roller pair 36. Thus, the cut piece 52 remains with the second end 52*b* located between the upstream transport roller pair 39 and the branch point P1, while the source portion 51 is transported in the reverse feeding direction D2. When the downstream end 51*a* of the source portion 51 passes with the junction P2 downstream, the control unit 49 stops the drive of the inverting roller 37 and the supply roller pair 36.

Figure 12:
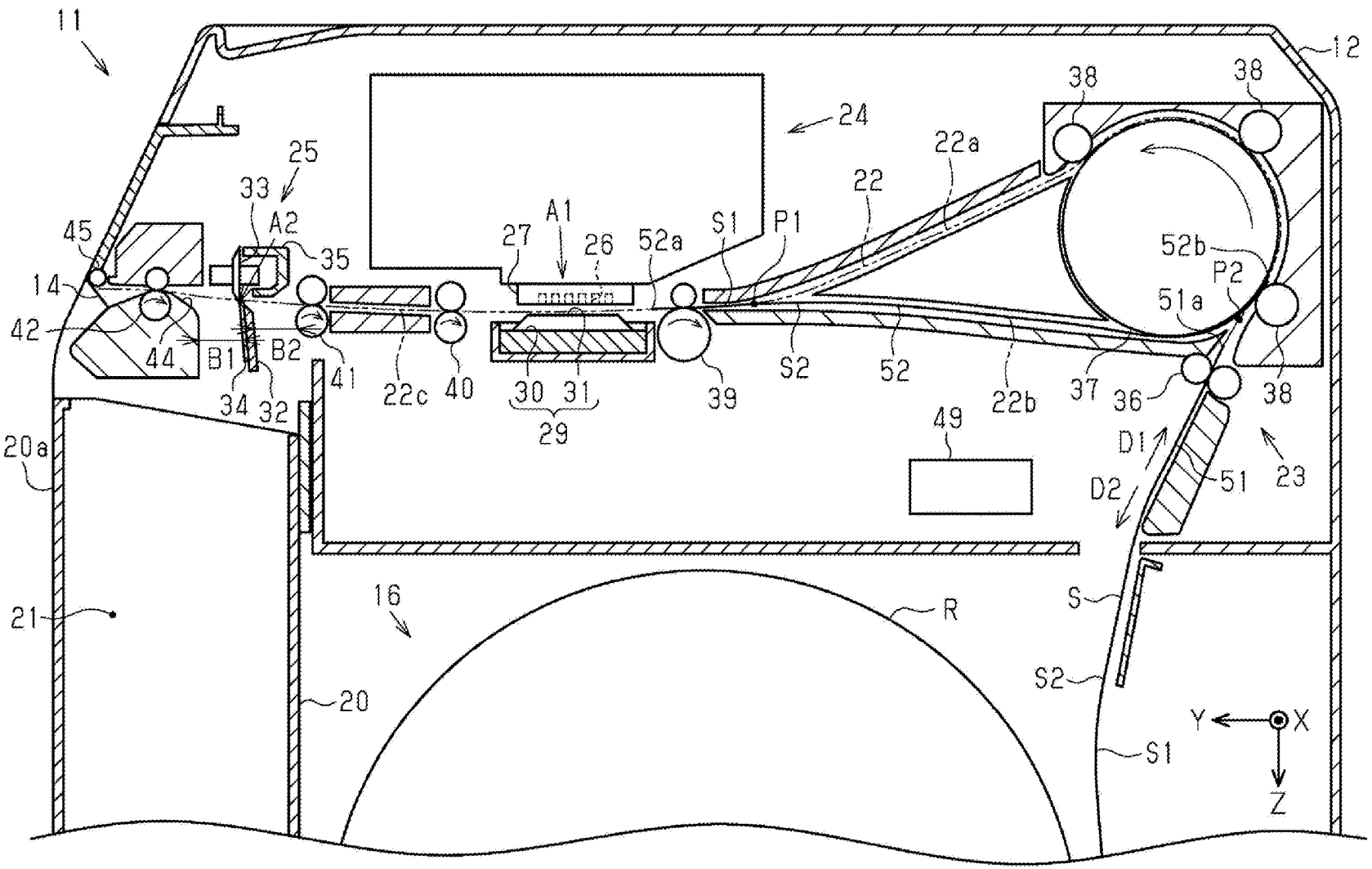
FIG. 12 is a cross-sectional view illustrating the printing apparatus performing a step of inverting the medium.

Next, as illustrated in FIG. 12, the control unit 49 executes the inverting step inverting the second surface S2 of the cut piece 52 to the upper surface. In the inverting step, the control unit 49 drives, in a state where the drive of the supply roller pair 36 is stopped, the inverting roller 37 in forward rotation, and the upstream transport roller pair 39, the downstream transport roller pair 40, the first roller pair 41, and the second roller pair 42 in reverse rotation. The transport unit 23 transports the cut piece 52 in the reverse feeding direction D2, transports the cut piece 52 from the branch point P1 to the inversion path 22*b*, and returns the cut piece 52 to the supply path 22*a* at the junction P2. The cut piece 52 returned to the supply path 22*a* is transported along the supply path 22*a* in the forward feeding direction D1. When the second end 52*b*, which becomes the downstream end of the cut piece 52, passes the upstream position of the upstream transport roller pair 39 during transportation in the forward feeding direction D1 after the inversion, the control unit 49 switches the upstream transport roller pair 39, the downstream transport roller pair 40, the first roller pair 41, and the second roller pair 42, which have been driven in reverse rotation, to the forward rotation drive.

The upstream end and the downstream end of the cut piece 52 are exchanged in the inverting step, the second end 52*b*, which has been the upstream end, becomes the downstream end, and the first end 52*a*, which has been the downstream end, becomes the upstream end. Further, the second surface S2, which has been the lower surface, becomes the upper surface, and the first surface S1, which has been the upper surface, becomes the lower surface. When the cut piece 52 passes through the junction P2 and is inverted, the control unit 49 drives the stopped supply roller pair 36 in forward rotation.

Figure 13:
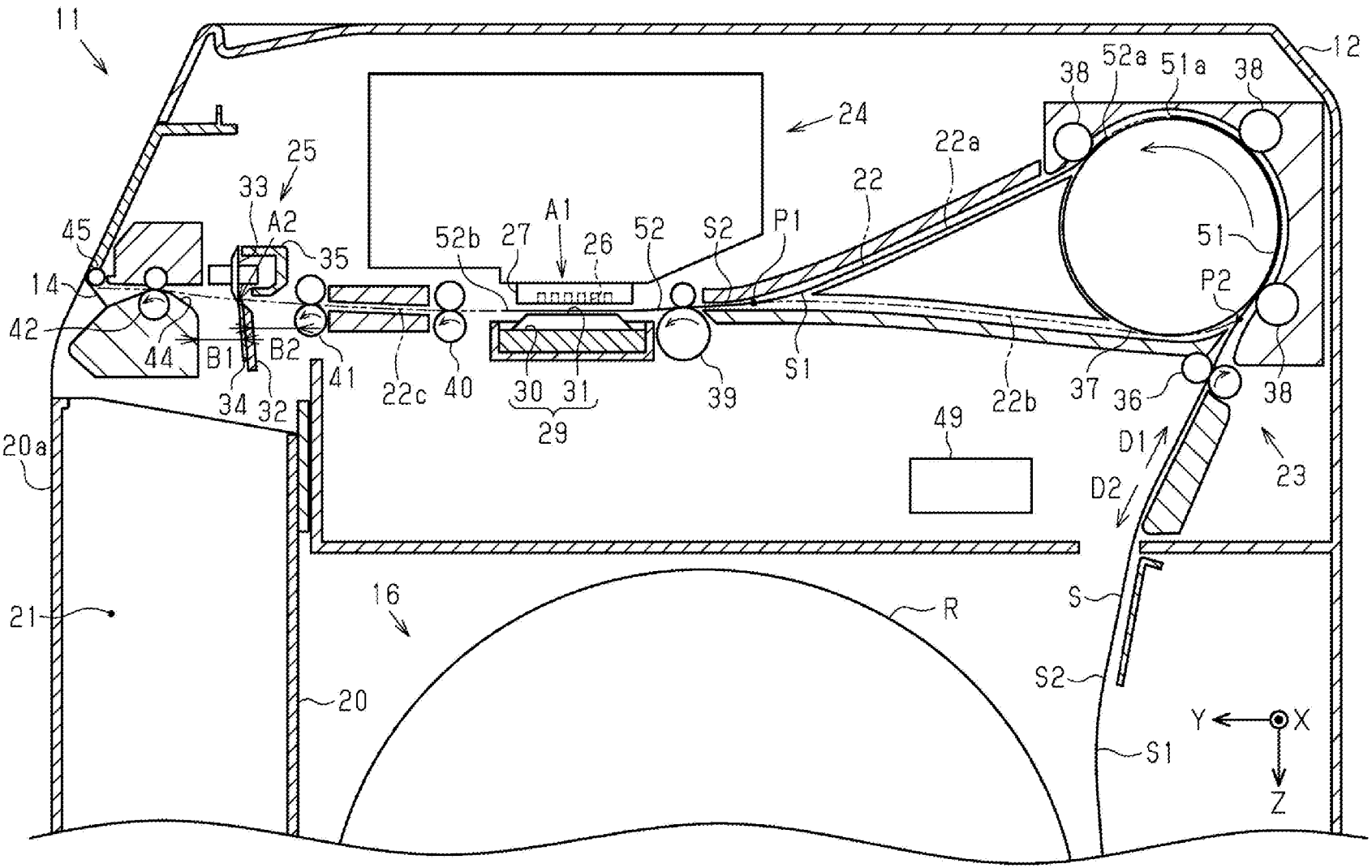
FIG. 13 is a cross-sectional view illustrating the printing apparatus performing a second printing step of printing on the medium.

Next, as illustrated in FIG. 13, the control unit 49 executes the second printing step of printing on the cut piece 52. In the second printing step, while the transport unit 23 transports the cut piece 52, which is a sheet-like medium, in the forward feeding direction D1, the printing unit 24 prints by ejecting ink toward the second surface S2 of the cut piece 52 located at the printing position A1.

Figure 14:
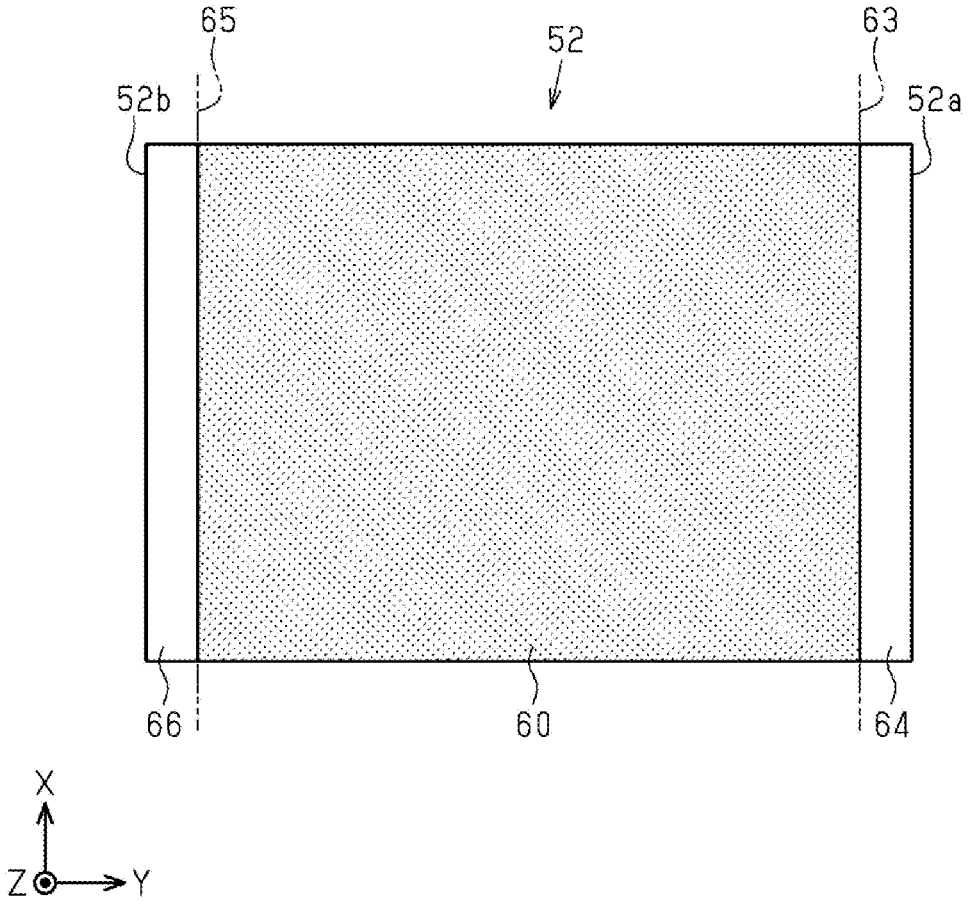
FIG. 14 is a plan view of the medium after the second printing step.
Figure 15:
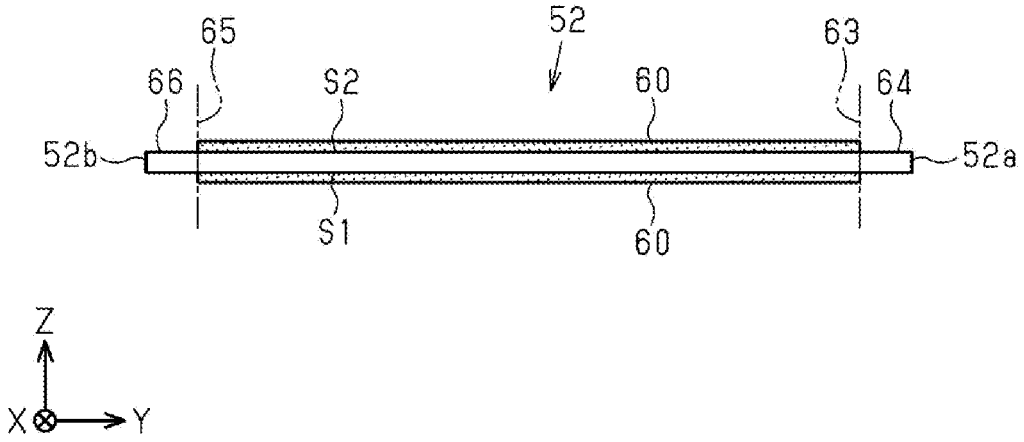
FIG. 15 is a cross-sectional view of the medium after the second printing step.

That is, as illustrated in FIGS. 14 and 15, a print area 60 is formed at the second surface S2 of the cut piece 52, which is the sheet-like medium. The print area 60 coincides with the print area 60 printed on the first surface S1 in the front-rear direction Y. Further, in the second surface S2 of the cut piece 52, the area between the second end 52*b*, which is the downstream end when being transported in the forward feeding direction D1, and the print area 60 is a margin 66 as a downstream margin adjacent to the print area 60 with the boundary 65 along the width direction X interposed therebetween. Similarly, in the second surface S2 of the cut piece 52, the area between the first end 52*a*, which is the upstream end when being transported in the forward feeding direction D1, and the print area 60 is a margin 64 as an upstream margin adjacent to the print area 60 with the boundary 63 along the width direction X interposed therebetween. Since the cut piece 52 includes such a margin 66 as the downstream margin and a margin 64 as the upstream margin on both sides of the print area 60, the posture is stabilized, so that printing defects in the second printing step are suppressed.

Figure 16:
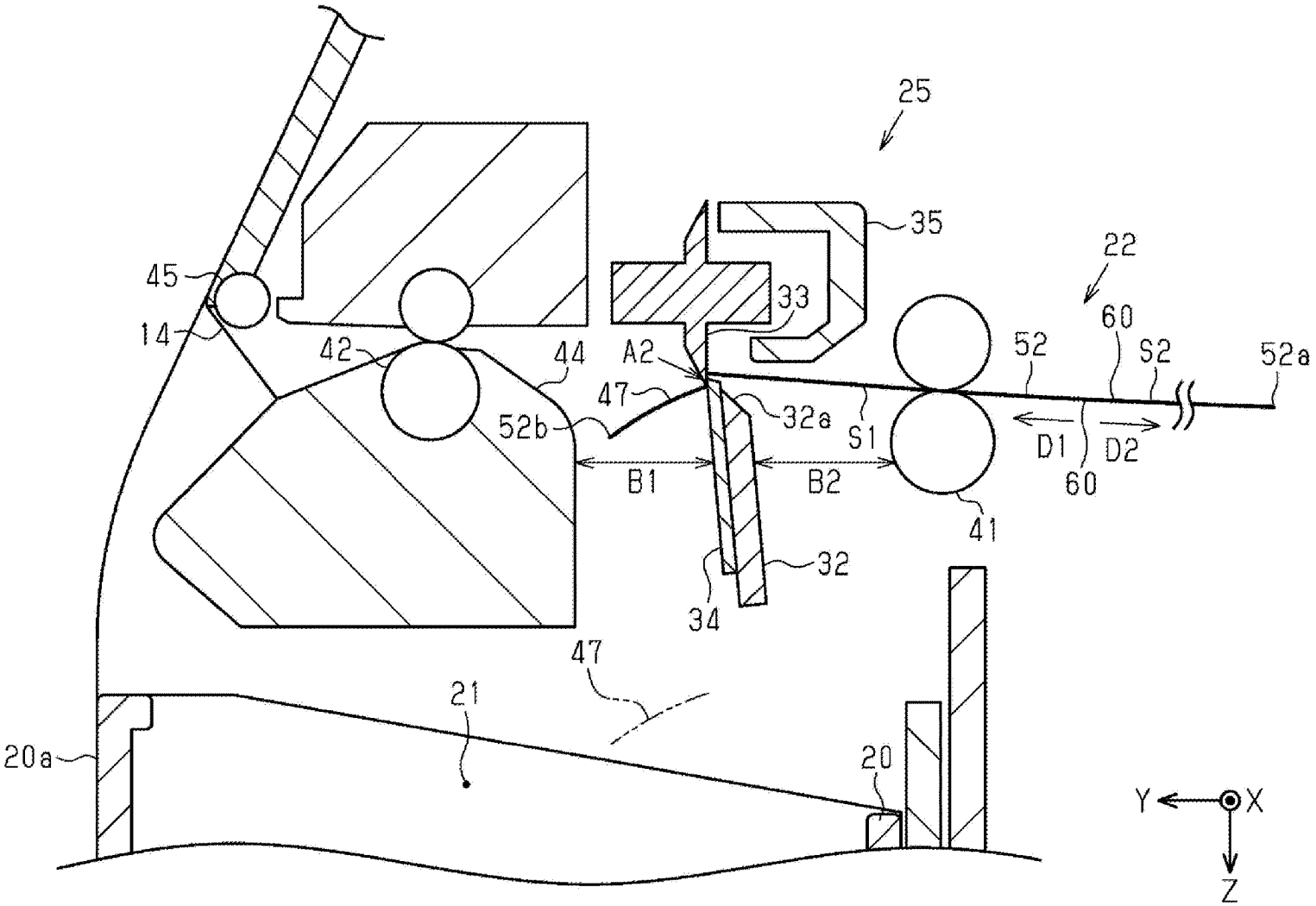
FIG. 16 is a cross-sectional view illustrating the printing apparatus performing a step of cutting-off the cutting waste on a downstream end side.

Next, as illustrated in FIG. 16, when the boundary 65 between the margin 66, which is the downstream margin, and the print area 60 in the cut piece 52 transported in the forward feeding direction D1 reaches the cutting position A2, the control unit 49 executes a downstream margin cutting-off step of cutting off the cutting waste 47, which is a portion of the margin 66, from the cut piece 52 in a state where the drive of the transport unit 23 is stopped. That is, the moving blade 33 having a blade edge brought into contact with the fixed blade 34 cuts the cut piece 52 by moving in the first direction, which is the width direction X from one side to another side, across the cut piece 52 along the boundary 65. As a result, the cutting waste 47, which is the portion of the margin 66, is cut off from the cut piece 52 on the downstream side of the cutting position A2. Then, the cutting waste 47 falls through the gap B1 downstream of the cutting position A2 as illustrated by the two-dot chain line in FIG. 16 and is accommodated in the accommodating chamber 21 of the accommodating unit 20 blow.

Figure 17:
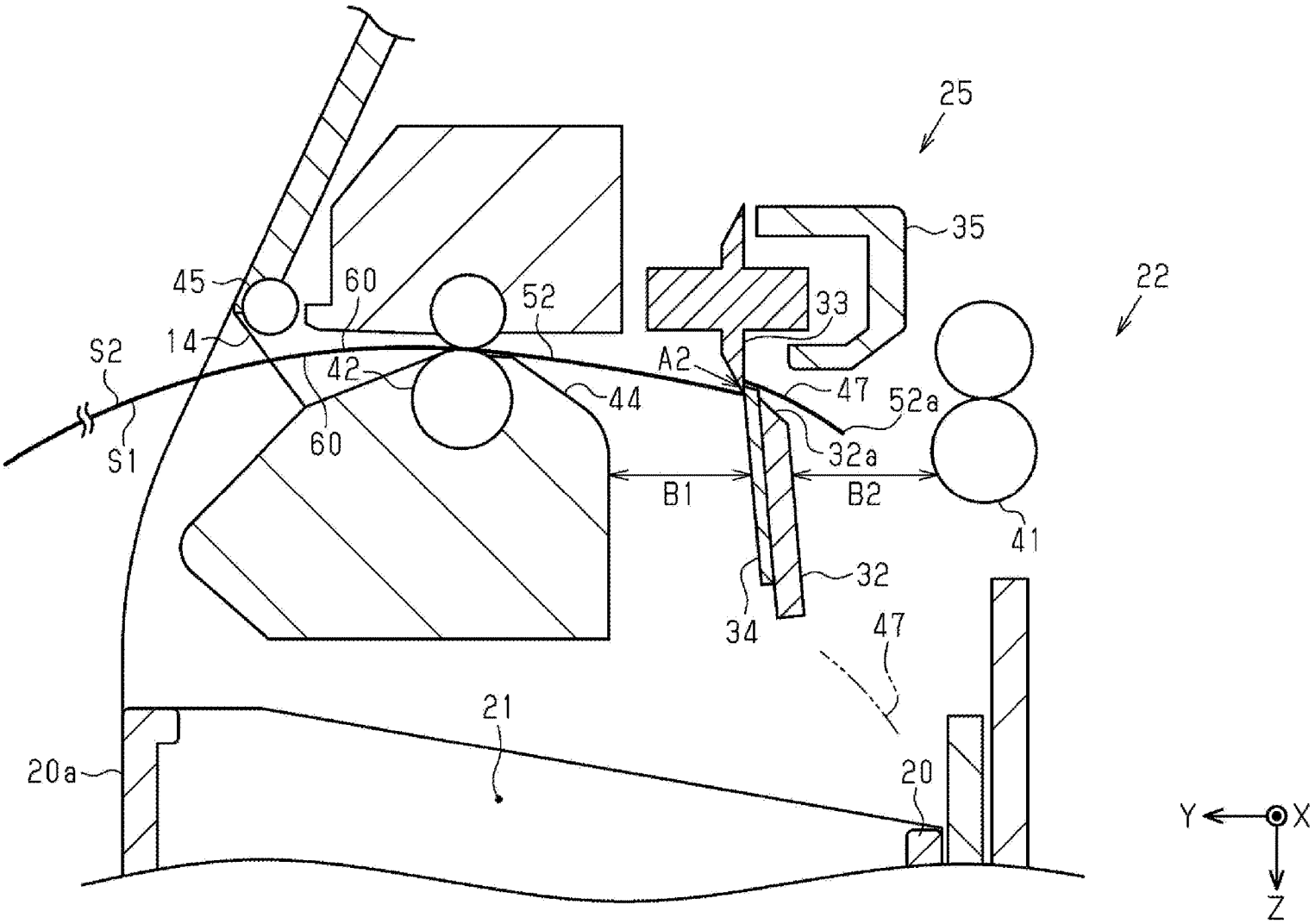
FIG. 17 is a cross-sectional view illustrating the printing apparatus performing a step of cutting-off the cutting waste on an upstream end side.

Next, as illustrated in FIG. 17, when the boundary 63 between the margin 64, which is the upstream margin, and the print area 60 in the cut piece 52 transported in the forward feeding direction D1 reaches the cutting position A2, the control unit 49 executes an upstream margin cutting-off step of cutting off the cutting waste 47, which is a portion of the margin 64, from the cut piece 52 in a state where the drive of the transport unit 23 is stopped. That is, the moving blade 33 having a blade edge brought into contact with the fixed blade 34 cuts the cut piece 52 by moving in the second direction, which is the width direction X from the other side to the one side, across the cut piece 52 along the boundary 63. As a result, the cutting waste 47, which is the portion of the margin 64, is cut off from the cut piece 52 on the upstream side of the cutting position A2. Then, the cutting waste 47 falls through the gap B2 upstream of the cutting position A2 as illustrated by the two-dot chain line in FIG. 17 and is accommodated in the accommodating chamber 21 of the accommodating unit 20 below.

In addition, in this case, since the upper end of the main body frame 32, which faces the gap B2 and fixes the fixed blade 34, is a slope 32*a* inclined diagonally downward toward the inside of the gap B2, the cutting waste 47 cut off from the cut piece 52 to the upstream side of the cutting position A2 falls through the gap B2 without being caught and is accommodated in the accommodating unit 20. Note that the portion cut off from the cut piece 52 in each of the step of cutting-off the downstream margin and the step of cutting-off the upstream margin includes a portion overlapped with the source portion 51 in the overlapping step and the reverse feeding step. Thereafter, the control unit 49 discharges the cut piece 52 printed at both sides from the discharge port 14.

Effects of the embodiment will be described.

(1) By cutting the boundary 65 between the margin 66 on the downstream end side and the print area 60 in the cut piece 52, which is the sheet-like medium, the cutting waste 47 on the downstream end side is generated downstream of the cutting position A2 in the cutting unit 25. On the other hand, cutting the boundary 63 between the margin 64 on the upstream end side and the print area 60 in the cut piece 52, which is the sheet-like medium, the cutting waste 47 on the upstream end side is generated upstream of the cutting position A2 in the cutting unit 25. In this case, in the embodiment, both the cutting waste 47 on the downstream end side and the cutting waste 47 on the upstream end side can be accommodated in the accommodating unit 20 through the gap B1 downstream and the gap B2 upstream of the cutting position A2.

(2) At the time of the second printing step in which the cut piece 52, which is the sheet-like medium having the printed first surface S1, is inverted and printed on the second surface S2, the margin 66, which is the downstream margin, and the margin 64, which is the upstream margin, are left in the cut piece 52. Thus, in the second printing step, by stabilizing the posture of the cut piece 52, printing defects can be suppressed, and in the subsequent cutting-off step, each of the margins 66 and 64 can be cut off as the cutting waste 47.

(3) Since the moving blade 33 is configured to move along the blade line of the fixed blade 34 in the state of being attached to the guide member 35 fixed to the main body frame in the same manner as the fixed blade 34 fixed to the main body frame 32, it is easy to stabilize the positional relationship between the fixed blade 34 and the moving blade 33 constituting the cutting unit 25.

(4) Not only when the moving blade 33 moves in the first direction along the blade line of the fixed blade 34, but also when the moving blade 33 moves in the second direction following the movement in the first direction, the cutting waste 47 can be cut off from the long medium S or the cut piece 52, which is the sheet-like medium. Therefore, the cutting waste 47 can be continuously and efficiently cut off.

(5) The accommodating unit 20 can accommodate the cutting waste 47 on the downstream end side and the cutting waste 47 on the upstream end side cut off from the cut piece 52, which is the sheet-like medium, together in the same one accommodating chamber 21, and the cutting waste 47 accommodated in the accommodating chamber 21 can be easily discarded by removing the accommodating unit 20 in a forward direction.

The present exemplary embodiment described above may be modified as follows. The present exemplary embodiment and modified examples thereof to be described below may be implemented in combination within a range in which a technical contradiction does not arise.

Figure 18:
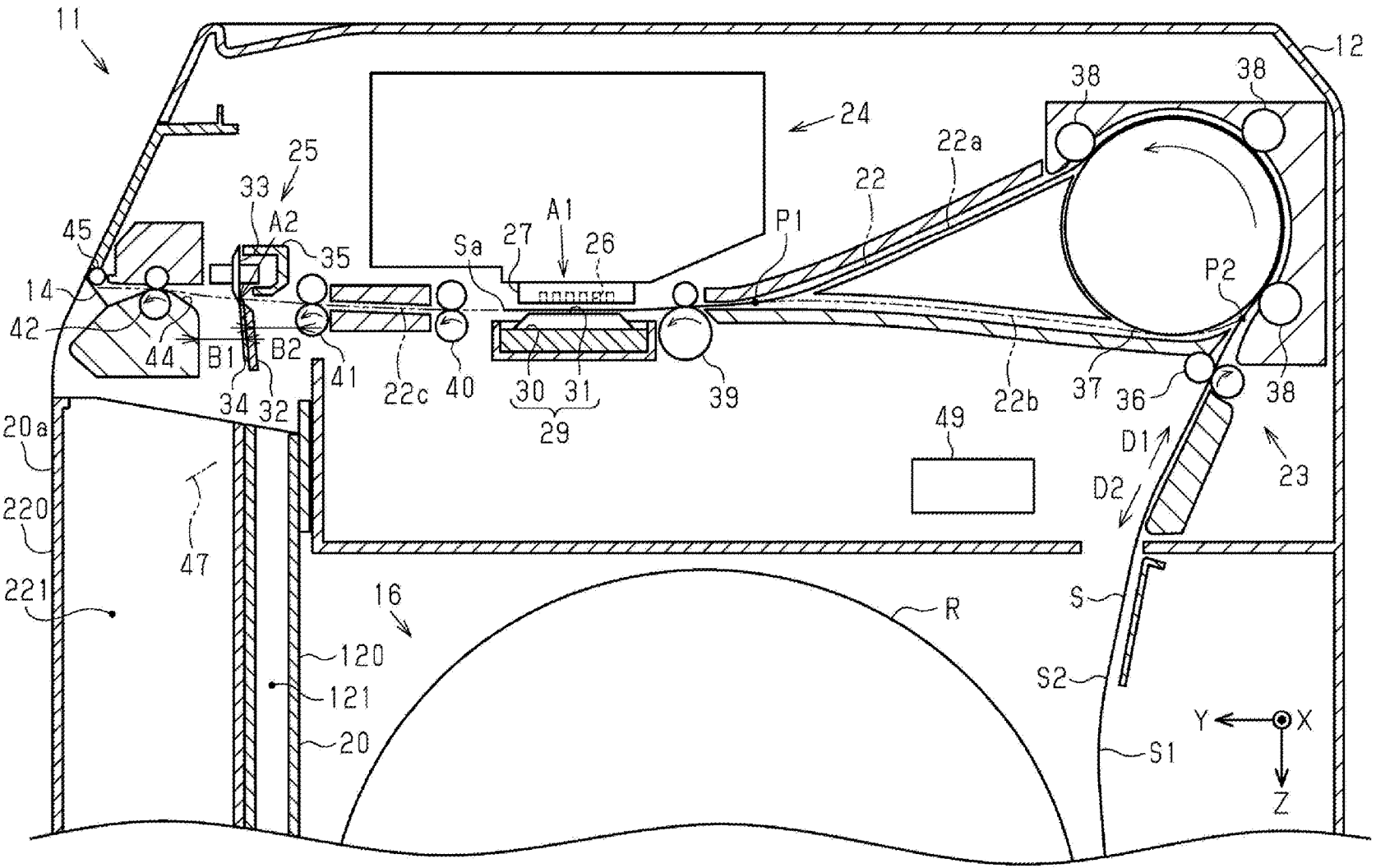
FIG. 18 is a cross-sectional view illustrating a printing apparatus according to a modified example.

As illustrated in FIG. 18, the accommodating unit 20 may be configured to include a first accommodating unit 120 including a first chamber 121 communicating with the gap B2 upstream of the cutting position A2 when the accommodating unit 20 is located below the cutting unit 25, and a second accommodating unit 220 including a second chamber 221 communicating with the gap B1 downstream of the cutting position A2 when the accommodating unit 20 is located below the cutting unit 25. In addition, in this case, at least the second accommodating unit 220 of the first accommodating unit 120 and the second accommodating unit 220 may be removable from below the cutting unit 25 toward a forward direction, which is a downstream direction in which the medium S is transported.

According to this configuration, since the second accommodating unit 220 including the second chamber 221 on the downstream side, which tends to collect more cutting waste 47 than the first chamber 121 on the upstream side, is removable, the cutting waste 47 accommodated in the second chamber 221 can be easily discarded.

Figure 19:
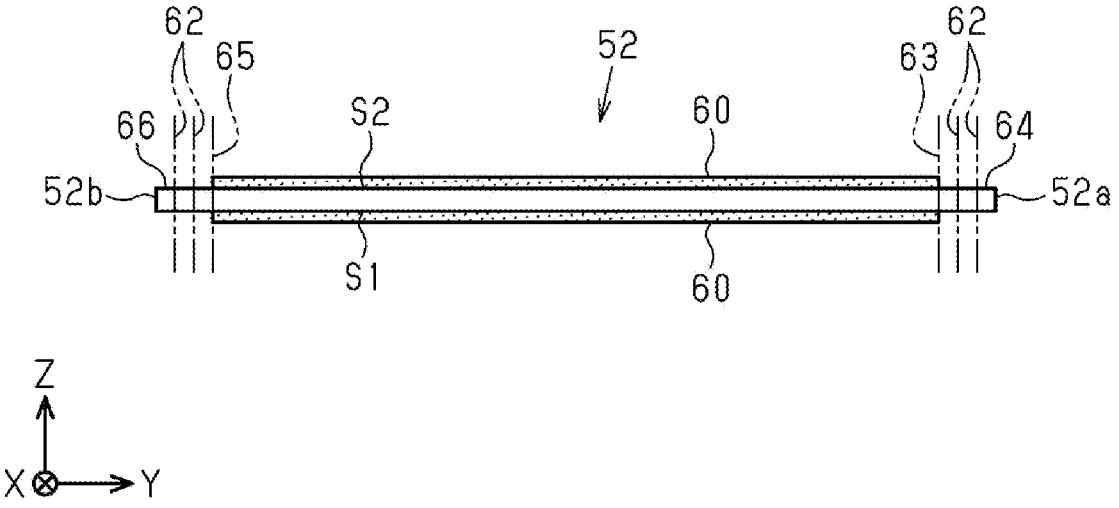
FIG. 19 is a cross-sectional view of a medium of the modified example after the second printing step.

As illustrated in FIG. 19, the cutting unit 25 may be configured to cut the margin 66, which is the downstream margin, and the margin 64, which is the upstream margin, in the cut piece 52, which is the sheet-like medium, into a plurality of pieces of paper along a plurality of cutting lines 62 parallel to the width direction X, respectively.

According to this configuration, each of the cutting waste 47 on the downstream end side generated by cutting the margin 66, which is the downstream margin, and the cutting waste 47 on the upstream end side generated by cutting the margin 64, which is the upstream margin, can be narrowed. As a result, the upstream gap B2 and the downstream gap B1 through which such cutting waste 47 falls can be made narrow, which can contribute to making the printing apparatus 11 compact. Note that, when printing without borders on the long medium S, the margin portion 61 between the print areas 60 is wider than when printing with borders. Therefore, it is preferable to narrow the cutting waste 47 generated by cutting the margin portion in order to make the printing apparatus 11 compact.

The cutting unit 25 may be configured to cut the medium S when the moving blade 33 moves along the blade line of the fixed blade 34 in either the first direction or the second direction of the width direction X.

The cutting unit 25 may be configured not to include the fixed blade 34 but include the moving blade 33 that moves in the width direction X or the moving blade 33 that moves in a direction intersecting the front-rear direction Y to cut the medium S. In this case, since the fixed blade 34 does not exist, when the moving blade 33 retracts from the cutting position to the retracted position the gaps B1 and B2 for dropping the cutting waste 47 can be widen.

The accommodating unit 20 may be fixed below the cutting unit 25 without being removed from the housing 12 of the printing apparatus 11. However, in this case, it is preferable to provide an opening/closing lid or the like at the front face 20*a* of the accommodating unit 20 so that the cutting waste 47 can be taken out from inside the accommodating chamber 21.

The margin 66 as the downstream margin and the margin 64 as the upstream margin in the cut piece 52, which is the sheet-like medium, is not limited to the area where the image is not printed at all, and may be a predetermined area including a part of the print area 60 within an area that does not affect the quality of the image printed in the print area 60. In other words, the cutting unit 25 may cut the cut piece 52, which is the sheet-like medium having the print area 60, at a position different from the boundary 65 between the margin 66 and the print area 60, and the boundary 63 between the margin 64 and the print area 60, and may cut off a portion including the margin 66 on the side of the second end 52*b*, which is the downstream end during transportation, and a portion including the margin 64 on the side of the first end 52*a*, which is the upstream end during transportation.

The printing apparatus 11 is an apparatus that prints images such as characters, pictures, and photographs by adhering a liquid such as ink or a fluid on the medium, and may be a serial printer, a lateral printer, a line printer, a page printer, or the like. Further, the printing apparatus may be an offset printing apparatus, a textile printing apparatus, or the like. The printing apparatus may have at least a printing function for printing on a medium, and may be a multifunctional apparatus having a function other than the printing function.

Hereinafter, technical concepts and effects thereof that are understood from the above-described exemplary embodiment and modified examples will be described.

(A) A printing apparatus includes a printing unit configured to print on a medium, a cutting unit configured to cut the medium downstream of the printing unit in a transport path through which the medium is transported, and an accommodating unit disposed below the cutting unit and configured to accommodate cutting waste generated when the medium is cut by the cutting unit, in which the cutting unit is configured to cut the medium at a boundary between a downstream margin that is an area between a downstream end of the medium and a print area on which printing is performed by the printing unit and the print area, and is configured to cut the medium at a boundary between an upstream margin that is an area between an upstream end of the medium and the print area and the print area, and gaps communicating with the accommodating unit are configured upstream and downstream of a position in which the medium is cut by the cutting unit in the transport path.

According to this configuration, downstream end side cutting waste that is generated downstream of the cutting position in the cutting unit by cutting the medium at the boundary between the downstream margin of the medium and the print area, and upstream end side cutting waste that is generated upstream of the cutting position in the cutting unit by cutting the medium at the boundary between the upstream margin of the medium and the print area, can be accommodated in the accommodating unit through each of the gaps downstream and upstream of the cutting position.

(B) In the printing apparatus, the cutting unit may be configured to cut the medium at a boundary between the downstream margin and the print area and a boundary between the upstream margin and the print area in a second surface that is different from a first surface of the medium on which printing was performed by the printing unit.

According to this configuration, at the time when the medium having the printed first surface is inverted and the second surface of the medium is printed, the downstream margin and the upstream margin are left in the medium in order to stabilize a posture of the medium, and after printing on the second surface is completed, the downstream end side cutting waste and the upstream end side cutting waste can be accommodated in the accommodating unit through the respective gaps downstream and upstream of the cutting position.

(C) In the printing apparatus, the cutting unit may be configured to include a fixed blade having a blade line extending in a direction intersecting the transport path, a guide member configured to extend along the blade line of the fixed blade, and a moving blade attached to the guide member and configured to move along the blade line of the fixed blade, and the fixed blade and the guide member may be configured to be fixed to a main body frame of the printing apparatus.

According to this configuration, since the moving blade is configured to move along the blade line of the fixed blade in the state of being attached to the guide member fixed to the main body frame in the same manner as the fixed blade, it is easy to stabilize the positional relationship between the fixed blade and the moving blade constituting the cutting unit.

(D) In the printing apparatus, the cutting unit may be configured to cut the medium both when the moving blade moves in a first direction and when the moving blade moves in a second direction opposite to the first direction.

According to this configuration, not only when the moving blade moves in the first direction along the blade line of the fixed blade, but also when the moving blade moves in the second direction following the movement in the first direction, the cutting waste can be cut off from the medium. Therefore, the cutting waste can be continuously and efficiently cut off.

(E) In the printing apparatus, the accommodating unit may include an accommodating chamber that is configured to communicate with both the gap upstream of the cutting position and the gap downstream of the cutting position when the accommodating unit is located below the cutting unit, and may be removable from below the cutting unit toward a front side that is a downstream side in a transport direction of the medium.

According to this configuration, the accommodating unit can accommodate the cutting waste on the downstream end side and the cutting waste on the upstream end side cut off from the medium together in the same one accommodating chamber, and the cutting waste accommodated in the accommodating chamber can be easily discarded by removing the accommodating unit in a forward direction.

(F) In the printing apparatus, the accommodating unit may be configured to include a first accommodating unit including a first chamber configured to communicate with the gap upstream of the cutting position when the accommodating unit is located below the cutting unit, and a second accommodating unit including a second chamber configured to communicate with the gap downstream of the cutting position when the accommodating unit is located below the cutting unit, and at least the second accommodating unit of the first accommodating unit and the second accommodating unit may be removable from below the cutting unit toward a front side that is a downstream side in a transport direction of the medium.

According to this configuration, since the second accommodating unit including the second chamber on the downstream side, which tends to collect more cutting waste than the first chamber on the upstream side, is removable, the cutting waste accommodated in the second chamber can be easily discarded.

(G) In the printing apparatus, the cutting unit may be configured to cut the upstream margin into a plurality of pieces of paper.

According to this configuration, since the cutting waste on the upstream end side generated by cutting the upstream margin can be narrowed, the upstream gap for dropping such cutting waste can be made narrow, which can contribute to making the apparatus compact.

(H) In the printing apparatus, the cutting unit may be configured to cut the downstream margin into a plurality of pieces of paper.

According to this configuration, since the cutting waste on the downstream end side generated by cutting the downstream margin can be narrowed, the downstream gap for dropping such cutting waste can be made narrow, which can contribute to making the apparatus compact.

What is claimed is:

1. A printing apparatus comprising:

a printing unit configured to perform printing on a medium;

a cutting unit configured to cut the medium downstream of the printing unit in a transport path through which the medium is transported; and an accommodating unit disposed below the cutting unit and configured to accommodate cutting waste generated when the medium is cut by the cutting unit, wherein the cutting unit is configured to cut the medium at a first boundary between a downstream margin that is an area between a downstream end of the medium and a print area on which printing is performed by the printing unit, and the print area, and is configured to cut the medium at a second boundary between an upstream margin that is an area between an upstream end of the medium and the print area, and the print area, gaps communicating with the accommodating unit are formed upstream and downstream of a position in which the medium is cut by the cutting unit in the transport path, and the cutting unit cuts the medium at the first boundary between the downstream margin and the print area and the second boundary between the upstream margin and the print area in a second surface that is different from a first surface of the medium on which printing was performed by the printing unit.

2. The printing apparatus according to claim 1, wherein the cutting unit includes a fixed blade having a blade line extending in a direction intersecting the transport path, a guide member configured to extend along the blade line of the fixed blade, and a moving blade attached to the guide member and configured to move along the blade line of the fixed blade, and the fixed blade and the guide member are fixed to a main body frame of the printing apparatus.

3. The printing apparatus according to claim 2, wherein the cutting unit cuts the medium both when the moving blade moves in a first direction and when the moving blade moves in a second direction opposite to the first direction.

4. The printing apparatus according to claim 1, wherein, the accommodating unit includes an accommodating chamber that is configured to communicate with both the gap upstream of the cutting position and the gap downstream of the cutting position when the accommodating unit is located below the cutting unit, and is removable from below the cutting unit toward a front side that is a downstream side in a transport direction of the medium.

5. The printing apparatus according to claim 1, wherein the cutting unit cuts the upstream margin into a plurality of pieces of paper.

6. The printing apparatus according to claim 1, wherein the cutting unit cuts the downstream margin into a plurality of pieces of paper.

7. A printing apparatus comprising:

a printing unit configured to perform printing on a medium;

a cutting unit configured to cut the medium downstream of the printing unit in a transport path through which the medium is transported; and an accommodating unit disposed below the cutting unit and configured to accommodate cutting waste generated when the medium is cut by the cutting unit, wherein the cutting unit is configured to cut the medium at a first boundary between a downstream margin that is an area between a downstream end of the medium and a print area on which printing is performed by the printing unit, and the print area, and is configured to cut the medium at a second boundary between an upstream margin that is an area between an upstream end of the medium and the print area, and the print area, gaps communicating with the accommodating unit are formed upstream and downstream of a position in which the medium is cut by the cutting unit in the transport path, the accommodating unit includes, a first accommodating unit including a first chamber configured to communicate with the gap upstream of the cutting position when the accommodating unit is located below the cutting unit, and a second accommodating unit including a second chamber configured to communicate with the gap downstream of the cutting position when the accommodating unit is located below the cutting unit, and the second accommodating unit is removable from below the cutting unit toward a front side that is a downstream side in a transport direction of the medium.

8. A printing apparatus comprising:

a printing unit configured to perform printing on a medium;

a cutting unit configured to cut the medium downstream of the printing unit in a transport path through which the medium is transported; and an accommodating unit disposed below the cutting unit and configured to accommodate cutting waste generated when the medium is cut by the cutting unit, wherein the cutting unit is configured to cut the medium at a first boundary between a downstream margin that is an area between a downstream end of the medium and a print area on which printing is performed by the printing unit, and the print area, and is configured to cut the medium at a second boundary between an upstream margin that is an area between an upstream end of the medium and the print area, and the print area, gaps communicating with the accommodating unit are formed upstream and downstream of a position in which the medium is cut by the cutting unit in the transport path, and the cutting unit cuts the medium having a first surface on which printing was performed by the printing unit, at an intermediate position of the downstream margin and an intermediate position of the upstream margin, and cuts the medium having a second surface on which printing was printed by the printing unit, at a boundary between the downstream margin and the print area and a boundary between the upstream margin and the print area, the second surface being different from the first surface on which printing was performed.

9. The printing apparatus according to claim 8, wherein the cutting unit includes a fixed blade having a blade line extending in a direction intersecting the transport path, a guide member configured to extend along the blade line of the fixed blade, and a moving blade attached to the guide member and configured to move along the blade line of the fixed blade, and the fixed blade and the guide member are fixed to a main body frame of the printing apparatus.

10. The printing apparatus according to claim 9, wherein the cutting unit cuts the medium both when the moving blade moves in a first direction and when the moving blade moves in a second direction opposite to the first direction.

11. The printing apparatus according to claim 8, wherein, the accommodating unit includes an accommodating chamber that is configured to communicate with both the gap upstream of the cutting position and the gap downstream of the cutting position when the accommodating unit is located below the cutting unit, and is removable from below the cutting unit toward a front side that is a downstream side in a transport direction of the medium.

12. The printing apparatus according to claim 8, wherein the cutting unit cuts the upstream margin into a plurality of pieces of paper.

13. The printing apparatus according to claim 8, wherein the cutting unit cuts the downstream margin into a plurality of pieces of paper.

* * * * *